US009349279B2

(12) United States Patent
Sangha et al.

(10) Patent No.: US 9,349,279 B2
(45) Date of Patent: May 24, 2016

(54) SYSTEMS AND METHODS FOR COMPENSATING FOR SENSOR DRIFT IN A HAZARD DETECTION SYSTEM

(71) Applicant: Google Inc., Mountain View, CA (US)

(72) Inventors: Eli Sangha, Sanger, CA (US); Andrew W. Goldenson, Palo Alto, CA (US)

(73) Assignee: GOOGLE INC., Mountain View, CA (US)

( * ) Notice: Subject to any disclaimer, the term of this patent is extended or adjusted under 35 U.S.C. 154(b) by 97 days.

(21) Appl. No.: 14/452,161

(22) Filed: Aug. 5, 2014

(65) Prior Publication Data

US 2016/0042638 A1 Feb. 11, 2016

(51) Int. Cl.
*G08B 17/10* (2006.01)
*G08B 29/04* (2006.01)

(52) U.S. Cl.
CPC ..... *G08B 29/043* (2013.01); *G08B 17/10* (2013.01)

(58) Field of Classification Search
None
See application file for complete search history.

(56) References Cited

U.S. PATENT DOCUMENTS

2014/0015680 A1* 1/2014 Chandler ..... G08B 17/12 340/630
2015/0233879 A1* 8/2015 Tolmie ..... G01N 33/0006 128/202.22
2015/0282741 A1* 10/2015 Brister ..... A61B 5/0002 600/345

* cited by examiner

*Primary Examiner* — Julie Lieu
(74) *Attorney, Agent, or Firm* — Van Court & Aldridge LLP

(57) ABSTRACT

Systems and methods for compensating for sensor drift of a smoke sensor are described herein. Sensor drift may be caused by accumulated buildup of dust or other particulates within an enclosure of the smoke sensor. Embodiments described herein can account for sensor drift by adjusting a clear air offset value.

29 Claims, 11 Drawing Sheets

SYSTEMS AND METHODS FOR COMPENSATING FOR SENSOR DRIFT IN A HAZARD DETECTION SYSTEM

TECHNICAL FIELD

This patent specification relates to systems and methods for compensating for sensor drift in a hazard detection system.

BACKGROUND

Hazard detection systems, such as smoke detectors, carbon monoxide detectors, combination smoke and carbon monoxide detectors, as well as systems for detecting other conditions have been used in residential, commercial, and industrial settings for safety and security considerations. Many hazard detection systems operate according to a set of standards defined by a governing body (e.g., Occupational Safety and Health Administration), or companies approved to perform safety testing (e.g., Underwriters Laboratories (UL)). For example, UL defines thresholds for when a smoke detector should sound an alarm and for when a carbon monoxide detector should sound an alarm.

SUMMARY

Systems and methods for compensating for sensor drift of a smoke sensor are described herein. Sensor drift may be caused by accumulated buildup of dust or other particulates within an enclosure of the smoke sensor. Embodiments described herein can account for sensor drift by adjusting a clear air offset value. For example, in one embodiment, a method of compensating for sensor drift of a smoke sensor can include calculating a smoke level value based, in part, on a sensor value calculated based on readings obtained from the smoke sensor and a clear air offset value, and adjusting the clear air offset value in response to changes in dust accumulation within an enclosure of the smoke sensor such that an increase in accumulated dust causes an upward sensor drift and a decrease in accumulated dust causes a downward sensor drift. A first filter may be used to calculate a reseed value based, in part, on the sensor value, and a second filter may be used to calculate an adjusted clear air offset value based, in part, on the sensor value and the clear air offset value, and the clear air offset value can be selectively set to one of the adjusted clear air offset value and the reseed value depending on whether a downward sensor drift is detected.

In another embodiment, a hazard detection system can include a smoke sensor and a safety processor. The safety processor can be operative to determine a sensor value based on data obtained from the smoke sensor every sample period, determine a smoke level value based, in part, on the sensor value and a clear air offset value, execute at least one sensor state machine by determining state transitions based, in part, on the smoke level value; and update the clear air offset value each sample period by incorporating the sensor value into a filter, wherein the filter comprises a rate of change scaling factor that substantially limits a magnitude impact the sensor value has on the updated clear air offset value.

A further understanding of the nature and advantages of the embodiments discussed herein may be realized by reference to the remaining portions of the specification and the drawings.

DETAILED DESCRIPTION OF THE DISCLOSURE

In the following detailed description, for purposes of explanation, numerous specific details are set forth to provide a thorough understanding of the various embodiments. Those of ordinary skill in the art will realize that these various embodiments are illustrative only and are not intended to be limiting in any way. Other embodiments will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual embodiment, numerous embodiment-specific decisions may be required to achieve specific design objectives. These design objectives will vary from one embodiment to another and from one developer to another. Moreover, it will be appreciated that such a development effort might be complex and time-consuming but would nevertheless be a routine engineering undertaking for those of ordinary skill in the art having the benefit of this disclosure.

It is to be appreciated that while one or more hazard detection embodiments are described further herein in the context of being used in a residential home, such as a single-family residential home, the scope of the present teachings is not so limited. More generally, hazard detection systems are applicable to a wide variety of enclosures such as, for example, duplexes, townhomes, multi-unit apartment buildings, hotels, retail stores, office buildings, and industrial buildings. Further, it is understood that while the terms user, customer, installer, homeowner, occupant, guest, tenant, landlord, repair person, and the like may be used to refer to the person or persons who are interacting with the hazard detector in the context of one or more scenarios described herein, these references are by no means to be considered as limiting the scope of the present teachings with respect to the person or persons who are performing such actions.

Figure 1:
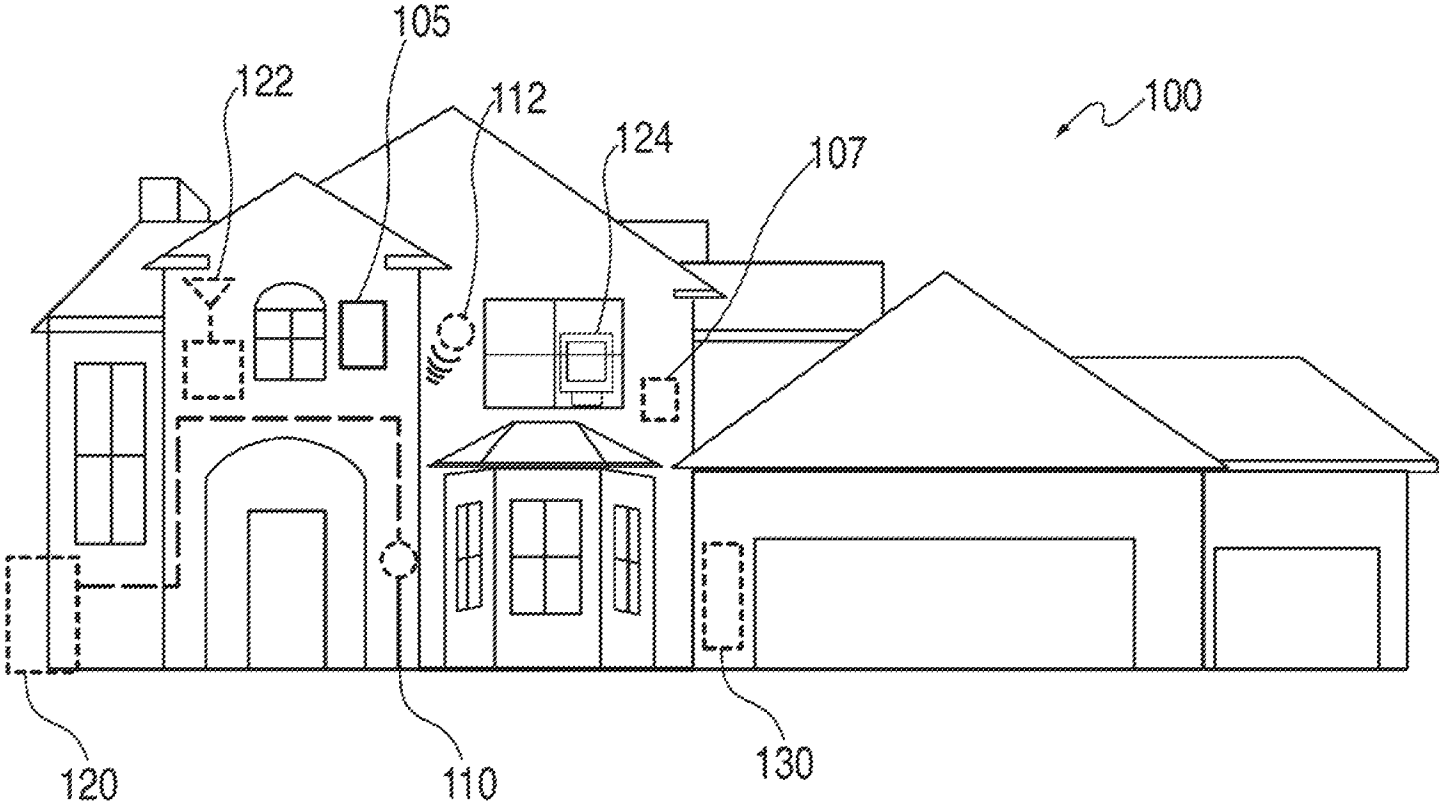
FIG. 1 is a diagram of an enclosure with a hazard detection system, according to some embodiments.

FIG. 1 is a diagram illustrating an exemplary enclosure 100 using hazard detection system 105, remote hazard detection system 107, thermostat 110, remote thermostat 112, heating, cooling, and ventilation (HVAC) system 120, router 122, computer 124, and central panel 130 in accordance with some embodiments. Enclosure 100 can be, for example, a single-family dwelling, a duplex, an apartment within an apartment building, a warehouse, or a commercial structure such as an office or retail store. Hazard detection system 105 can be battery powered, line powered, or line powered with a battery backup. Hazard detection system 105 can include one or more processors, multiple sensors, non-volatile storage, and other circuitry to provide desired safety monitoring and user interface features. Some user interface features may only be available in line powered embodiments due to physical limitations and power constraints. In addition, some features common to both line and battery powered embodiments may be implemented differently. Hazard detection system 105 can include the following components: low power wireless personal area network (6LoWPAN) circuitry, a system processor, a safety processor, non-volatile memory (e.g., Flash), WiFi circuitry, an ambient light sensor (ALS), a smoke sensor, a carbon monoxide (CO) sensor, a temperature sensor, a humidity sensor, a noise sensor, one or more ultrasonic sensors, a passive infra-red (PIR) sensor, a speaker, one or more light emitting diodes (LED's), and an alarm buzzer.

Hazard detection system 105 can monitor environmental conditions associated with enclosure 100 and alarm occupants when an environmental condition exceeds a predetermined threshold. The monitored conditions can include, for example, smoke, heat, humidity, carbon monoxide, carbon dioxide, radon, and other gasses. In addition to monitoring the safety of the environment, hazard detection system 105 can provide several user interface features not found in conventional alarm systems. These user interface features can include, for example, vocal alarms, voice setup instructions, cloud communications (e.g. push monitored data to the cloud, or push notifications to a mobile telephone, or receive software updates from the cloud), device-to-device communications (e.g., communicate with other hazard detection systems in the enclosure), visual safety indicators (e.g., display of a green light indicates it is safe and display of a red light indicates danger), tactile and non-tactile input command processing, and software updates.

It should be understood that hazard detection system 105 may be implemented as a smart home device. Thus, although the discussion of the hazard detection system is described primarily with reference to specific hazards (e.g., smoke, CO, heat), the hazard detection system may provide additional features and functionality unrelated to those hazards. For example, the hazard detection system may monitor many different conditions. These conditions can include motions, sounds, and smells. These conditions can also include data supplied by remote sensors (e.g., armbands, door sensors, window sensors, personal media devices).

Hazard detection system 105 can implement multi-criteria state machines according to various embodiments described herein to provide advanced hazard detection and advanced user interface features such as pre-alarms. In addition, the multi-criteria state machines can manage alarming states and pre-alarming states and can include one or more sensor state machines that can control the alarming states and one or more system state machines that control the pre-alarming states. Each state machine can transition among any one of its states based on sensor data values, hush events, and transition conditions. The transition conditions can define how a state machine transitions from one state to another, and ultimately, how hazard detection system 105 operates. Hazard detection system 105 can use a dual processor arrangement to execute the multi-criteria state machines according to various embodiments. The dual processor arrangement may enable hazard detection system 105 to manage the alarming and pre-alarming states in a manner that uses minimal power while simultaneously providing relatively failsafe hazard detection and alarming functionalities. Additional details of the various embodiments of hazard detection system 105 are discussed below.

Enclosure 100 can include any number of hazard detection systems. For example, as shown, hazard detection system 107 is another hazard detection system, which may be similar to system 105. In one embodiment, both systems 105 and 107 can be battery powered systems. In another embodiment, system 105 may be line powered, and system 107 may be battery powered. Moreover, a hazard detection system can be installed outside of enclosure 100.

Thermostat 110 can be one of several thermostats that may control HVAC system 120. Thermostat 110 can be referred to as the "primary" thermostat because it may be electrically connected to actuate all or part of an HVAC system, by virtue of an electrical connection to HVAC control wires (e.g. W, G, Y, etc.) leading to HVAC system 120. Thermostat 110 can include one or more sensors to gather data from the environment associated with enclosure 100. For example, a sensor may be used to detect occupancy, temperature, light and other environmental conditions within enclosure 100. Remote thermostat 112 can be referred to as an "auxiliary" thermostat because it may not be electrically connected to actuate HVAC system 120, but it too may include one or more sensors to gather data from the environment associated with enclosure 100 and can transmit data to thermostat 110 via a wired or wireless link. For example, thermostat 112 can wirelessly communicate with and cooperates with thermostat 110 for improved control of HVAC system 120. Thermostat 112 can provide additional temperature data indicative of its location within enclosure 100, provide additional occupancy information, or provide another user interface for the user (e.g., to adjust a temperature setpoint).

Hazard detection systems 105 and 107 can communicate with thermostat 110 or thermostat 112 via a wired or wireless link. For example, hazard detection system 105 can wirelessly transmit its monitored data (e.g., temperature and occupancy detection data) to thermostat 110 so that it is provided with additional data to make better informed decisions in controlling HVAC system 120. Moreover, in some embodiments, data may be transmitted from one or more of thermostats 110 and 112 to one or more of hazard detections systems 105 and 107 via a wired or wireless link.

Central panel 130 can be part of a security system or other master control system of enclosure 100. For example, central panel 130 may be a security system that may monitor windows and doors for break-ins, and monitor data provided by motion sensors. In some embodiments, central panel 130 can also communicate with one or more of thermostats 110 and 112 and hazard detection systems 105 and 107. Central panel 130 may perform these communications via wired link, wireless link, or a combination thereof. For example, if smoke is detected by hazard detection system 105, central panel 130 can be alerted to the presence of smoke and make the appropriate notification, such as displaying an indicator that a particular zone within enclosure 100 is experiencing a hazard condition.

Enclosure 100 may further include a private network accessible both wirelessly and through wired connections and may also be referred to as a Local Area Network or LAN.

Network devices on the private network can include hazard detection systems 105 and 107, thermostats 110 and 112, computer 124, and central panel 130. In one embodiment, the private network is implemented using router 122, which can provide routing, wireless access point functionality, firewall and multiple wired connection ports for connecting to various wired network devices, such as computer 124. Wireless communications between router 122 and networked devices can be performed using an 802.11 protocol. Router 122 can further provide network devices access to a public network, such as the Internet or the Cloud, through a cable-modem, DSL modem and an Internet service provider or provider of other public network services. Public networks like the Internet are sometimes referred to as a Wide-Area Network or WAN.

Access to the Internet, for example, may enable networked devices such as system 105 or thermostat 110 to communicate with a device or server remote to enclosure 100. The remote server or remote device can host an account management program that manages various networked devices contained within enclosure 100. For example, in the context of hazard detection systems according to embodiments discussed herein, system 105 can periodically upload data to the remote server via router 122. In addition, if a hazard event is detected, the remote server or remote device can be notified of the event after system 105 communicates the notice via router 122. Similarly, system 105 can receive data (e.g., commands or software updates) from the account management program via router 122.

Hazard detection system 105 can operate in one of several different power consumption modes. Each mode can be characterized by the features performed by system 105 and the configuration of system 105 to consume different amounts of power. Each power consumption mode corresponds to a quantity of power consumed by hazard detection system 105, and the quantity of power consumed can range from a lowest quantity to a highest quantity. One of the power consumption modes corresponds to the lowest quantity of power consumption, and another power consumption mode corresponds to the highest quantity of power consumption, and all other power consumption modes fall somewhere between the lowest and the highest quantities of power consumption. Examples of power consumption modes can include an Idle mode, a Log Update mode, a Software Update mode, an Alarm mode, a Pre-Alarm mode, a Hush mode, and a Night Light mode. These power consumption modes are merely illustrative and are not meant to be limiting. Additional or fewer power consumption modes may exist. Moreover, any definitional characterization of the different modes described herein is not meant to be all inclusive, but rather, is meant to provide a general context of each mode.

Although one or more states of the sensor state machines and system state machines may be implemented in one or more of the power consumption modes, the power consumption modes and states may be different. For example, the power consumption mode nomenclature is used in connection with various power budgeting systems and methods that are explained in more detail in U.S. Provisional Application Nos. 61/847,905 and 61/847,916.

Figure 2:
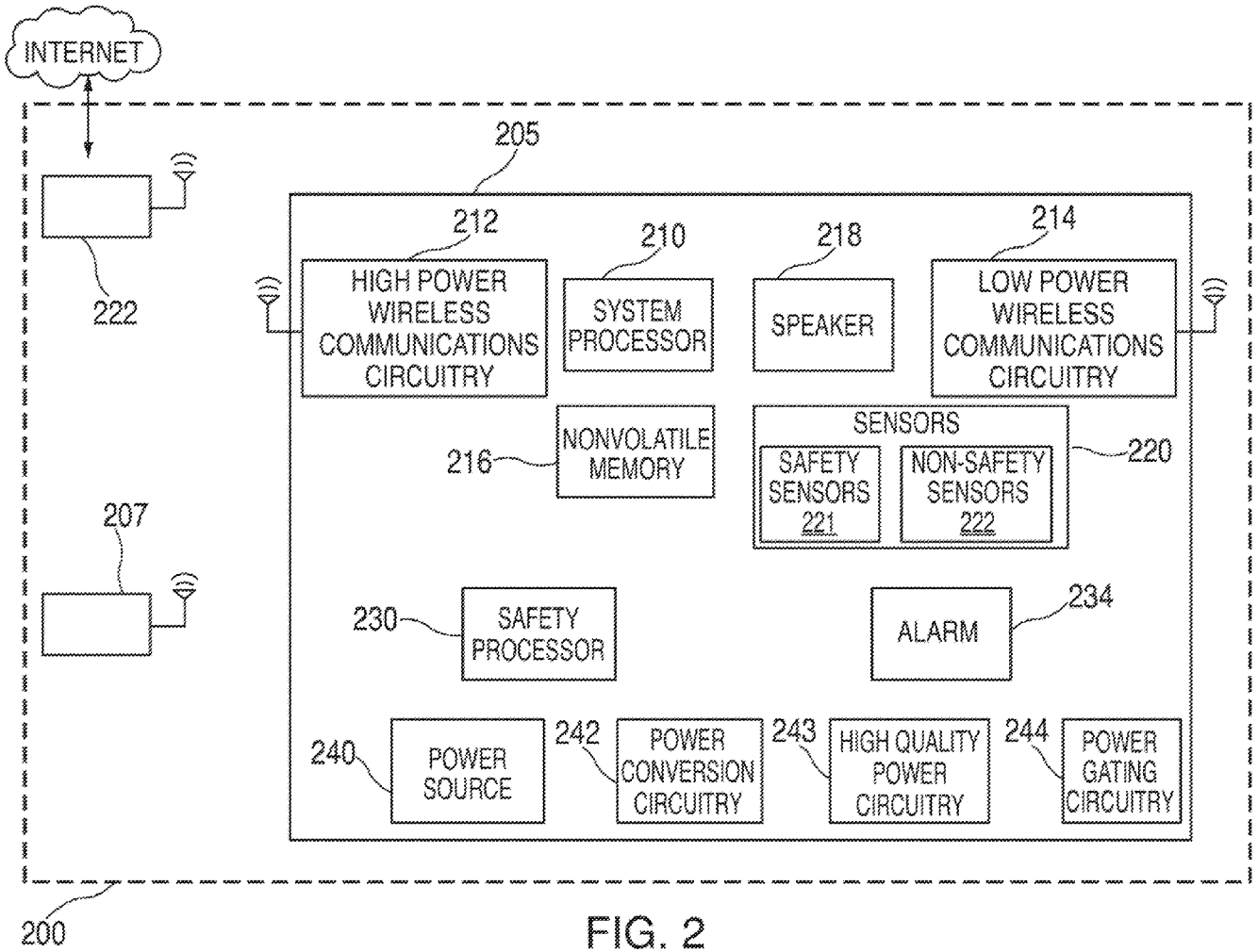
FIG. 2 shows an illustrative block diagram of a hazard detection system being used in an illustrative enclosure, according to some embodiments.

FIG. 2 shows an illustrative block diagram of hazard detection system 205 being used in an illustrative enclosure 200 in accordance with some embodiments. FIG. 2 also shows optional hazard detection system 207 and router 222. Hazard detection systems 205 and 207 can be similar to hazard detection systems 105 and 107 in FIG. 1, enclosure 200 can be similar to enclosure 100 in FIG. 1, and router 222 can be similar to router 122 in FIG. 1. Hazard detection system 205 can include several components, including system processor 210, high-power wireless communications circuitry 212 and antenna, low-power wireless communications circuitry 214 and antenna, non-volatile memory 216, speaker 218, sensors 220, which can include one or more safety sensors 221 and one or more non-safety sensors 222, safety processor 230, alarm 234, power source 240, power conversion circuitry 242, high quality power circuitry 243, and power gating circuitry 244. Hazard detection system 205 may be operative to provide failsafe safety detection features and user interface features using circuit topology and power budgeting methods that may minimize power consumption.

Hazard detection system 205 can use a bifurcated processor circuit topology for handling the features of system 205. Both system processor 210 and safety processor 230 can exist on the same circuit board within system 205, but perform different tasks. System processor 210 is a larger more capable processor that can consume more power than safety processor 230. That is, when both processors 210 and 230 are active, processor 210 consumes more power than processor 230. Similarly, when both processors are inactive, processor 210 may consume more power than processor 230. System processor 210 can be operative to process user interface features. For example, processor 210 can direct wireless data traffic on both high and low power wireless communications circuitries 212 and 214, access non-volatile memory 216, communicate with processor 230, and cause audio to be emitted from speaker 218. As another example, processor 210 can monitor data acquired by one or more sensors 220 to determine whether any actions need to be taken (e.g., shut off a blaring alarm in response to a user detected action to hush the alarm).

Safety processor 230 can be operative to handle safety related tasks of system 205. Safety processor 230 can poll one or more of sensors 220 and activate alarm 234 when one or more of sensors 220 indicate a hazard event is detected. Processor 230 can operate independently of processor 210 and can activate alarm 234 regardless of what state processor 210 is in. For example, if processor 210 is performing an active function (e.g., performing a WiFi update) or is shut down due to power constraints, processor 230 can activate alarm 234 when a hazard event is detected. In some embodiments, the software running on processor 230 may be permanently fixed and may never be updated via a software or firmware update after system 205 leaves the factory. In other embodiments, processor 230 may be updated when system 205 is in the field.

Compared to processor 210, processor 230 is a less power consuming processor. Thus by using processor 230 in lieu of processor 210 to monitor a subset of sensors 220 yields a power savings. If processor 210 were to constantly monitor sensors 220, the power savings may not be realized. In addition to the power savings realized by using processor 230 for monitoring the subset of sensors 220, bifurcating the processors also ensures that the safety monitoring and core alarming features of system 205 will operate regardless of whether processor 210 is functioning. By way of example and not by way of limitation, system processor 210 may comprise a relatively high-powered processor such as Freescale Semiconductor K60 Microcontroller, while safety processor 230 may comprise a relatively low-powered processor such as a Freescale Semiconductor KL15 Microcontroller. Overall operation of hazard detection system 205 entails a judiciously architected functional overlay of system processor 210 and safety processor 230, with system processor 210 performing selected higher-level, advanced functions that may not have been conventionally associated with hazard detection units (for example: more advanced user interface and communications functions; various computationally-intensive algorithms to sense patterns in user behavior or patterns in ambient conditions; algorithms for governing, for example, the brightness of an LED night light as a function of ambient brightness levels; algorithms for governing, for example, the sound level of an onboard speaker for home intercom functionality; algorithms for governing, for example, the issuance of voice commands to users; algorithms for uploading logged data to a central server; algorithms for establishing network membership; and so forth), and with safety processor 230 performing the more basic functions that may have been more conventionally associated with hazard detection units (e.g., smoke and CO monitoring, actuation of shrieking/buzzer alarms upon alarm detection). By way of example and not by way of limitation, system processor 210 may consume on the order of 18 mW when it is in a relatively high-power active state and performing one or more of its assigned advanced functionalities, whereas safety processor 230 may only consume on the order of 0.05 mW when it is performing its basic monitoring functionalities. However, again by way of example and not by way of limitation, system processor 210 may consume only on the order of 0.005 mW when in a relatively low-power inactive state, and the advanced functions that it performs are judiciously selected and timed such the system processor is in the relatively high power active state only about 0.05% of the time, and spends the rest of the time in the relatively low-power inactive state. Safety processor 230, while only requiring an average power draw of 0.05 mW when it is performing its basic monitoring functionalities, should of course be performing its basic monitoring functionalities 100% of the time. According to one or more embodiments, the judiciously architected functional overlay of system processor 210 and safety processor 230 is designed such that hazard detection system 205 can perform basic monitoring and shriek/buzzer alarming for hazard conditions even in the event that system processor 210 is inactivated or incapacitated, by virtue of the ongoing operation of safety processor 230. Therefore, while system processor 210 is configured and programmed to provide many different capabilities for making hazard detection unit 205 an appealing, desirable, updatable, easy-to-use, intelligent, network-connected sensing and communications node for enhancing the smart-home environment, its functionalities are advantageously provided in the sense of an overlay or adjunct to the core safety operations governed by safety processor 230, such that even in the event there are operational issues or problems with system processor 210 and its advanced functionalities, the underlying safety-related purpose and functionality of hazard detector 205 by virtue of the operation of safety processor 230 will continue on, with or without system processor 210 and its advanced functionalities.

High power wireless communications circuitry 212 can be, for example, a Wi-Fi module capable of communicating according to any of the 802.11 protocols. For example, circuitry 212 may be implemented using WiFi part number BCM43362, available from Murata. Depending on an operating mode of system 205, circuitry 212 can operate in a low power "sleep" state or a high power "active" state. For example, when system 205 is in an Idle mode, circuitry 212 can be in the "sleep" state. When system 205 is in a non-Idle mode such as a Wi-Fi update mode, software update mode, or alarm mode, circuitry 212 can be in an "active" state. For example, when system 205 is in an active alarm mode, high power circuitry 212 may communicate with router 222 so that a message can be sent to a remote server or device.

Low power wireless communications circuitry 214 can be a low power Wireless Personal Area Network (6LoWPAN) module or a ZigBee module capable of communicating according to a 802.15.4 protocol. For example, in one embodiment, circuitry 214 can be part number EM357 SoC available from Silicon Laboratories. Depending on the operating mode of system 205, circuitry 214 can operate in a relatively low power "listen" state or a relatively high power "transmit" state. When system 205 is in the Idle mode, WiFi update mode, or software update mode, circuitry 214 can be in the "listen" state. When system 205 is in the Alarm mode, circuitry 214 can transmit data so that the low power wireless communications circuitry in system 207 can receive data indicating that system 205 is alarming. Thus, even though it is possible for high power wireless communications circuitry 212 to be used for listening for alarm events, it can be more power efficient to use low power circuitry 214 for this purpose. Power savings may be further realized when several hazard detection systems or other systems having low power circuitry 214 form an interconnected wireless network.

Power savings may also be realized because in order for low power circuitry 214 to continually listen for data transmitted from other low power circuitry, circuitry 214 may constantly be operating in its "listening" state. This state consumes power, and although it may consume more power than high power circuitry 212 operating in its sleep state, the power saved versus having to periodically activate high power circuitry 214 can be substantial. When high power circuitry 212 is in its active state and low power circuitry 212 is in its transmit state, high power circuitry 212 can consume substantially more power than low power circuitry 214.

In some embodiments, low power wireless communications circuitry 214 can be characterized by its relatively low power consumption and its ability to wirelessly communicate according to a first protocol characterized by relatively low data rates, and high power wireless communications circuitry 212 can be characterized by its relatively high power consumption and its ability to wirelessly communicate according to a second protocol characterized by relatively high data rates. The second protocol can have a much more complicated modulation than the first protocol.

In some embodiments, low power wireless communications circuitry 214 may be a mesh network compatible module that does not require an access point or a router in order to communicate to devices in a network. Mesh network compatibility can include provisions that enable mesh network compatible modules to keep track of other nearby mesh network compatible modules so that data can be passed through neighboring modules. Mesh network compatibility is essentially the hallmark of the 802.15.4 protocol. In contrast, high power wireless communications circuitry 212 is not a mesh network compatible module and requires an access point or router in order to communicate to devices in a network. Thus, if a first device having circuitry 212 wants to communicate data to another device having circuitry 212, the first device has to communicate with the router, which then transmits the data to the second device. There is no device-to-device communication per se using circuitry 212.

Non-volatile memory 216 can be any suitable permanent memory storage such as, for example, NAND Flash, a hard disk drive, NOR, ROM, or phase change memory. In one embodiment, non-volatile memory 216 can store audio clips that can be played back by speaker 218. The audio clips can include installation instructions or warnings in one or more languages. Speaker 218 can be any suitable speaker operable to playback sounds or audio files. Speaker 218 can include an amplifier (not shown).

Sensors 220 can be monitored by system processor 210 and safety processor 230, and can include safety sensors 221 and non-safety sensors 222. One or more of sensors 220 may be exclusively monitored by one of system processor 210 and safety processor 230. As defined herein, monitoring a sensor refers to a processor's ability to acquire data from that monitored sensor. That is, one particular processor may be responsible for acquiring sensor data, and possibly storing it in a sensor log, but once the data is acquired, it can be made available to another processor either in the form of logged data or real-time data. For example, in one embodiment, system processor 210 may monitor one of non-safety sensors 222, but safety processor 230 cannot monitor that same non-safety sensor. In another embodiment, safety processor 230 may monitor each of the safety sensors 221, but may provide the acquired sensor data to system processor 210.

Safety sensors 221 can include sensors necessary for ensuring that hazard detection system 205 can monitor its environment for hazardous conditions and alert users when hazardous conditions are detected, and all other sensors not necessary for detecting a hazardous condition are non-safety sensors 222. In some embodiments, safety sensors 221 include only those sensors necessary for detecting a hazardous condition. For example, if the hazardous condition includes smoke and fire, then the safety sensors might only include a smoke sensor and at least one heat sensor. Other sensors, such as non-safety sensors, could be included as part of system 205, but might not be needed to detect smoke or fire. As another example, if the hazardous condition includes carbon monoxide, then the safety sensor might be a carbon monoxide sensor, and no other sensor might be needed to perform this task.

Thus, sensors deemed necessary can vary based on the functionality and features of hazard detection system 205. In one embodiment, hazard detection system 205 can be a combination smoke, fire, and carbon monoxide alarm system. In such an embodiment, detection system 205 can include the following necessary safety sensors 221: a smoke detector, a carbon monoxide (CO) sensor, and one or more heat sensors. Smoke detectors can detect smoke and typically use optical detection, ionization, or air sampling techniques. Optical scattering and obscuration detection techniques may use infrared light emitting diodes (LEDs) and photodiodes. When smoke and/or other matter (e.g., water vapor) enters a smoke chamber, the light emitted by the LED(s) may be scattered, which may enable the photodiodes to detect the light. If no smoke or other matter (e.g., water vapor) is in the smoke chamber, then the photodiodes may not be able to detect the light being emitted by the LED(s). Ionization techniques may use a radioactive material such as Americium-241 to ionize the air, which may create a measurable current between two plates. When smoke particles displace the air or neutralize the charge, the measured current can change, thereby indicating smoke is detected. In some geographic locations (e.g., Europe) traditional Americium-241 ionization smoke detectors are banned by regulatory agencies in part because of the necessity to dispose of a radioactive material at the end of the smoke detector's life.

A smoke detector can also use a non-radioactive ionization technique to detect the presence of smoke and/or other particulate matter. A non-radioactive ionizing detector may use a LED such as an ultraviolet emitting LED with a photocatalyst coating. The photocatalyst can generate ions when light (e.g., UV light) passes through it. When these ions are displaced or neutralized by smoke and/or other matter, the detector may detect a change in current between two plates and register a smoke event.

A CO sensor can detect the presence of carbon monoxide gas, which, in the home, is typically generated by open flames, space heaters, water heaters, blocked chimneys, and automobiles. The material used in electrochemical CO sensors typically has a 5-7 year lifespan. Thus, after a 5-7 year period has expired, the CO sensor should be replaced. A heat sensor can be a thermistor, which is a type of resistor whose resistance varies based on temperature. Thermistors can include negative temperature coefficient (NTC) type thermistors or positive temperature coefficient (PTC) type thermistors. Furthermore, in this embodiment, detection system 205 can include the following non-safety sensors 222: a humidity sensor, an ambient light sensor, a push-button sensor, a passive infra-red (PIR) sensor, and one or more ultrasonic sensors. A temperature and humidity sensor can provide relatively accurate readings of temperature and relative humidity. An ambient light sensor (ALS) can detect ambient light and the push-button sensor can be a switch, for example, that detects a user's press of the switch. A PIR sensor can be used for various motion detection features. A PIR sensor can measure infrared light radiating from objects in its field of view. Ultrasonic sensors can be used to detect the presence of an object. Such sensors can generate high frequency sound waves and determine which wave(s) are received back by the sensor. Sensors 220 can be mounted to a printed circuit board (e.g., the same board that processors 210 and 230 may be mounted to), a flexible printed circuit board, a housing of system 205, or a combination thereof.

In some embodiments, data acquired from one or more non-safety sensors 222 can be acquired by the same processor used to acquire data from one or more safety sensors 221. For example, safety processor 230 may be operative to monitor both safety and non-safety sensors 221 and 222 for power savings reasons, as discussed above. Although safety processor 230 may not need any of the data acquired from non-safety sensor 222 to perform its hazard monitoring and alerting functions, the non-safety sensor data can be utilized to provide enhanced hazard system 205 functionality. The enhanced functionality can be realized in alarming algorithms according to various embodiments discussed herein. For example, the non-sensor data can be utilized by system processor 210 to implement system state machines that may interface with one or more sensor state machines, all of which are discussed in more detail below in connection with the description accompanying FIG. 3 and in U.S. Provisional Application No. 61/847,937.

Alarm 234 can be any suitable alarm that alerts users in the vicinity of system 205 of the presence of a hazard condition. Alarm 234 can also be activated during testing scenarios. Alarm 234 can be a piezo-electric buzzer, for example.

Power source 240 can supply power to enable operation of system 205 and can include any suitable source of energy. Embodiments discussed herein can include AC line powered, battery powered, a combination of AC line powered with a battery backup, and externally supplied DC power (e.g., USB supplied power). Embodiments that use AC line power, AC line power with battery backup, or externally supplied DC power may be subject to different power conservation constraints than battery only embodiments. Battery powered embodiments are designed to manage power consumption of its finite energy supply such that hazard detection system 205 operates for a minimum period of time. In some embodiments, the minimum period of time can be one (1) year, three (3) years, or seven (7) years. In other embodiments, the minimum period of time can be at least seven (7) years, eight (8) years, nine (9) years, or ten (10) years. Line powered embodiments are not as constrained because their energy supply is virtually unlimited. Line powered with battery backup embodiments may employ power conservation methods to prolong the life of the backup battery.

In battery only embodiments, power source 240 can include one or more batteries or a battery pack. The batteries can be constructed from different compositions (e.g., alkaline or lithium iron disulfide) and different end-user configurations (e.g., permanent, user replaceable, or non-user replaceable) can be used. In one embodiment, six cells of Li—$FeS_2$ can be arranged in two stacks of three. Such an arrangement can yield about 27000 mWh of total available power for system 205.

Power conversion circuitry 242 includes circuitry that converts power from one level to another. Multiple instances of power conversion circuitry 242 may be used to provide the different power levels needed for the components within system 205. One or more instances of power conversion circuitry 242 can be operative to convert a signal supplied by power source 240 to a different signal. Such instances of power conversion circuitry 242 can exist in the form of buck converters or boost converters. For example, alarm 234 may require a higher operating voltage than high power wireless communications circuitry 212, which may require a higher operating voltage than processor 210, such that all required voltages are different than the voltage supplied by power source 240. Thus, as can be appreciated in this example, at least three different instances of power conversion circuitry 242 are required.

High quality power circuitry 243 is operative to condition a signal supplied from a particular instance of power conversion circuitry 242 (e.g., a buck converter) to another signal. High quality power circuitry 243 may exist in the form of a low-dropout regulator. The low-dropout regulator may be able to provide a higher quality signal than that provided by power conversion circuitry 242. Thus, certain components may be provided with "higher" quality power than other components. For example, certain safety sensors 221 such as smoke detectors and CO sensors may require a relatively stable voltage in order to operate properly.

Power gating circuitry 244 can be used to selectively couple and de-couple components from a power bus. De-coupling a component from a power bus insures that the component does not incur any quiescent current loss, and therefore can extend battery life beyond that which it would be if the component were not so de-coupled from the power bus. Power gating circuitry 244 can be a switch such as, for example, a MOSFET transistor. Even though a component is de-coupled from a power bus and does not incur any current loss, power gating circuitry 244 itself may consume a finite amount of power. This finite power consumption, however, is less than the quiescent power loss of the component.

It is understood that although hazard detection system 205 is described as having two separate processors, system processor 210 and safety processor 230, which may provide certain advantages as described hereinabove and hereinbelow, including advantages with regard to power consumption as well as with regard to survivability of core safety monitoring and alarming in the event of advanced feature provision issues, it is not outside the scope of the present teachings for one or more of the various embodiments discussed herein to be executed by one processor or by more than two processors.

Figure 3:
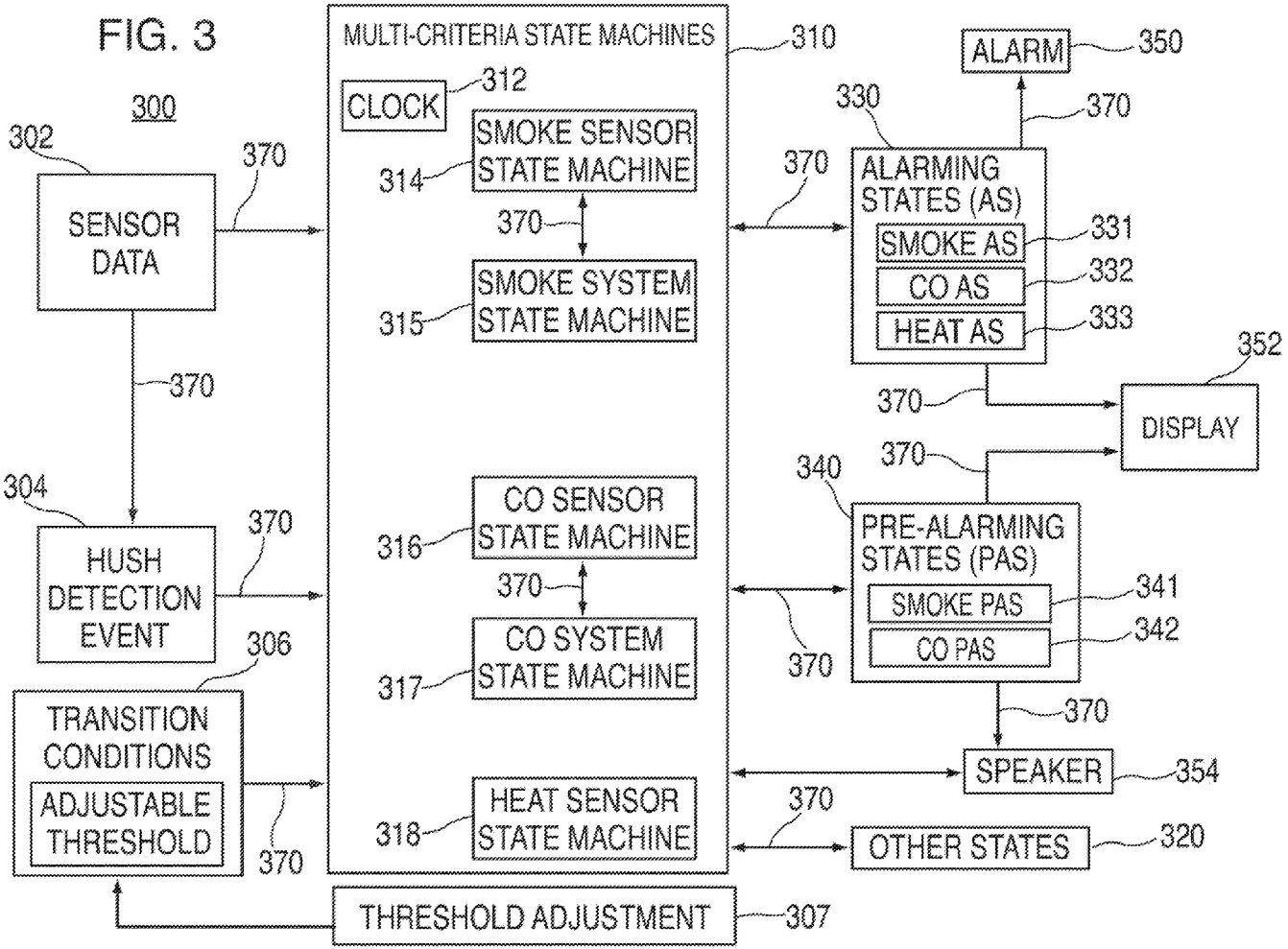
FIG. 3 shows an illustrative block diagram showing various components of a hazard detection system working together to provide multi-criteria alarming and pre-alarming functionality, according to some embodiments.

FIG. 3 shows an illustrative block diagram showing various components of hazard detection system 300 working together to provide multi-criteria alarming and pre-alarming functionalities according to various embodiments. As shown, system 300 can include sensor data 302, hush detection events 304, transition conditions 306, threshold adjustment parameter 307, multi-criteria state machines 310, clock 312, other states 320, alarming states 330, pre-alarming states 340, alarm 350, display 352, and speaker 354. Also shown are several communication links 370, each of which may have unidirectional or bidirectional data and/or signal communications capabilities. Multi-criteria state machines 310 can control alarming states 330, pre-alarming states 340, and all other state machine states 320 based on sensor data 302, hush detection events 304, transition conditions 306, clock 312, and other criteria, and alarming and pre-alarming states 330 and 340 can control the output of alarm 350, display 352, and speaker 354. Alarming states 330 can include multiple alarming states (e.g., one for each hazard, such as smoke alarming state 331, CO alarming state 332, and heat alarming state 333) and pre-alarming states 340 can include multiple pre-alarming states (e.g., one or more for each hazard, such as smoke pre-alarming state 341 and CO pre-alarming state 342. Other states can include, for example, idling states, monitoring states, alarm hushing states, pre-alarm hushing states, post-alarm states, holding states, and alarm monitoring states.

Alarming states 330 can control activation and deactivation of alarm 350 and display 352 in response to determinations made by multi-criteria state machines 310. Alarm 350 can provide audible cues (e.g., in the form of buzzer beeps) that a dangerous condition is present. Display 352 can provide a visual cue (e.g., such as flashing light or change in color) that a dangerous condition is present. If desired, alarming states 330 can control playback of messages over speaker 354 in conjunction with the audible and/or visual cues. For example, combined usage of alarm 350 and speaker 354 can repeat the following sequence: "BEEP, BEEP, BEEP—Smoke Detected In Bedroom—BEEP BEEP BEEP," where the "BEEPS" emanate from alarm 350 and "smoke detected in bedroom" emanates from speaker 354. As another example, usage of alarm 350 and speaker 354 can repeat the following sequence: "BEEP, BEEP, BEEP—Wave to Hush Alarm—BEEP BEEP BEEP," in which speaker 354 is used to provide alarming hush instructions. Any one of the alarming states 330 (e.g., smoke alarm state 331, CO alarm state 332, and heat alarm state 333) can independently control alarm 350 and/or display 352 and/or speaker 354. In some embodiments, alarming states 330 can cause alarm 350 or display 352 or speaker 354 to emit different cues based on which specific alarm state is active. For example, if a smoke alarm state is active, alarm 350 may emit a sound having a first characteristic, but if a CO alarm state is active, alarm 350 may emit a sound having a second characteristic. In other embodiments, alarming states 330 can cause alarm 350 and display 352 and speaker 354 to emit the same cue regardless of which specific alarm state is active.

Pre-alarming states 340 can control activation and deactivation of speaker 354 and display 352 in response to determinations made by multi-criteria state machines 310. Pre-alarming can serve as a warning that a dangerous condition may be imminent. Speaker 354 may be utilized to playback voice warnings that a dangerous condition may be imminent. Different pre-alarm messages may be played back over speaker 354 for each type of detected pre-alarm event. For example, if a smoke pre-alarm state is active, a smoke related message may be played back over speaker 354. If a CO pre-alarm state is active, a CO related message may be played back. Furthermore, different messages may be played back for each one of the multiple pre-alarms associated with each hazard (e.g., smoke and CO). For example, the smoke hazard may have two associated pre-alarms, one associated with a first smoke pre-alarming state (e.g., suggesting that an alarming state may be moderately imminent) and another one associated with a second smoke pre-alarming state (e.g., suggesting that an alarming state may be highly imminent). Pre-alarm messages may also include voice instructions on how to hush pre-alarm messages. Display 352 may also be utilized in a similar fashion to provide visual cues of an imminent alarming state. In some embodiments, the pre-alarm messages can specify the location of the pre-alarming conditions. For example, if hazard system 300 knows it is located in the bedroom, it can incorporate the location in the pre-alarm message: "Smoke Detected In Bedroom."

Hazard detection system 300 can enforce alarm and pre-alarm priorities depending on which conditions are present. For example, if elevated smoke and CO conditions exist at the same time, the smoke alarm state and/or pre-alarm smoke state may take precedence over the CO alarm state and/or CO pre-alarm state. If a user silences the smoke alarm or smoke pre-alarm, and the CO alarm state or CO pre-alarm state is still active, system 300 may provide an indication (e.g., a voice notification) that a CO alarm or pre-alarm has also been silenced. If a smoke condition ends and the CO alarm or pre-alarm is event is still active, the CO alarm or pre-alarm may be presented to the user.

Multi-criteria state machines 310 can transition to an idling state when it determines that relatively little or no dangerous conditions exist. The idling state can enforce a relatively low level of hazard detection system activity. For example, in the idle state, the data sampling rates of one or more sensors may be set at relatively slow intervals. Multi-criteria state machines 310 can transition to a monitoring state when it determines that sensor data values have risen to a level that warrants closer scrutiny, but not to a level that transitions to a pre-alarming or alarming state. The monitoring state can enforce a relatively high level of hazard detection system activity. For example, the data sampling rates of one or more sensors may be set at relatively fast intervals. In addition, the data sampling rates of one or more sensors may be set at relatively fast intervals for alarming states 330, pre-alarming states 340, or both.

Alarm hushing and pre-alarm hushing states may refer to a user-instructed deactivation of an alarm or a pre-alarm. For example, in one embodiment, a user can press a button (not shown) to silence an alarm or pre-alarm. In another embodiment, a user can perform a hush gesture in the presence of the hazard detection system. A hush gesture can be a user initiated action in which he or she performs a gesture (e.g., a wave motion) in the vicinity of system 300 with the intent to turn off or silence a blaring alarm. One or more ultrasonic sensors, a PIR sensor, or a combination thereof can be used to detect this gesture. The gesture hush feature and systems and methods for detecting and processing the gesture hush feature are discussed in more detail in U.S. Provisional Patent Application Nos. 61/847,960 and 61/889,013.

Post-alarming states may refer to states that multi-criteria state machines 310 can transition to after having been in one of alarming states 330 or one of pre-alarming states 340. In one post-alarming state, hazard detection system 300 can provide an "all clear" message to indicate that the alarm or pre-alarm condition is no longer present. This can be especially useful, for example, for CO because humans cannot detect CO. Another post-alarming state can be a holding state, which can serve as a system debounce state. This state can prevent hazard detection system 300 from immediately transitioning back to a pre-alarming state 340 after having just transitioned from an alarming state 330.

Multi-criteria state machines 310 can include several different state machines: sensor state machines and system state machines. Each state machine can be associated with a particular hazard such as, for example, a smoke hazard, a carbon monoxide hazard, or a heat hazard, and the multi-criteria state machines may leverage data acquired by one or more sensors in managing detection of a hazard. In some embodiments, a sensor state machine can be implemented for each hazard. In other embodiments, a system state machine may be implemented for each hazard or a subset of hazards. The sensor state machines can be responsible for controlling relatively basic hazard detection system functions and the system state machines can be responsible for controlling relatively advanced hazard detection system functions. In managing detection of a hazard, each sensor state machine and each system state machine can transition among any one of its states based on sensor data 302, hush events 304, and transition conditions 306. A hush event can be a user initiated command to hush, for example, a sounding alarm or pre-alarm voice instruction.

Transition conditions 306 can include a myriad of different conditions that may define how a state machine transitions from one state to another. Each state machine can have its own set of transition conditions, and examples of state machine specific transition conditions can be found in U.S. Provisional Application No. 61/847,937. The conditions can define thresholds that may be compared against any one or more of the following inputs: sensor data values, time clocks, and user interaction events (e.g., hush events). State change transitions can be governed by relatively simple conditions (e.g., single-criteria conditions), or relatively complex conditions (e.g., multi-criteria conditions). Single-criteria conditions may compare one input to one threshold. For example, a simple condition can be a comparison between a sensor data value and a threshold. If the sensor data value equals or exceeds the threshold, the state change transition may be executed. In contrast, a multi-criteria condition can be a comparison of one or more inputs to one or more thresholds. For example, a multi-criteria condition can be a comparison between a first sensor value and a first threshold and a comparison between a second sensor value and a second threshold. In some embodiments, both comparisons would need to be satisfied in order to effect a state change transition. In other embodiments, only one of the comparisons would need to be satisfied in order to effect a state change transition. As another example, a multi-criteria condition can be a comparison between a time clock and a time threshold and a comparison between a sensor value and a threshold.

In some embodiments, the threshold for a particular transition condition can be adjusted. Such thresholds are referred to herein as adjustable thresholds (e.g., shown as part of transition conditions 306). The adjustable threshold can be changed in response to threshold adjustment parameter 307, which may be provided, for example, by an alarm threshold setting module according to an embodiment. Adjustable thresholds can be selected from one of at least two different selectable thresholds, and any suitable selection criteria can be used to select the appropriate threshold for the adjustable threshold. In one embodiment, the selection criteria can include several single-criteria conditions or a multi-criteria condition. In another embodiment, if the adjustable threshold is compared to sensor values of a first sensor, the selection criteria can include an analysis of at least one sensor other than the first sensor. In another embodiment, the adjustable threshold can be the threshold used in a smoke alarm transition condition, and the adjustable threshold can be selected from one of three different thresholds.

In some embodiments, the threshold for a particular transition condition can be a learned condition threshold (not shown). The learned condition threshold can be the result of a difference function, which may subtract a constant from an initial threshold. The constant can be changed, if desired, based on any suitable number of criteria, including, for example, heuristics, field report data, software updates, user preferences, device settings, etc. Changing the constant can provide a mechanism for changing the transition condition for one or more states (e.g., a pre-alarming state). This constant can be provided to transition conditions 306 to make adjustments to the learned condition threshold. In one embodiment, the constant can be selected based on installation and setup of hazard detection system 300. For example, the home owner can indicate that hazard detection system 300 has been installed in a particular room of an enclosure. Depending on which room it is, system 300 can select an appropriate constant. For example, a first constant can be selected if the room is a bedroom and a second constant can be selected if the room is a kitchen. The first constant may be a value that makes hazard detection system 300 more sensitive to potential hazards than the second constant because the bedroom is in a location that is generally further away from an exit and/or is not generally susceptible to factors that may otherwise cause a false alarm. In contrast, the kitchen, for example, is generally closer to an exit than a bedroom and can generate conditions (e.g., steam or smoke from cooking) that may cause a false alarm. Other installation factors can also be taken into account in selecting the appropriate constant. For example, the home owner can specify that the room is adjacent to a bathroom. Since humidity stemming from a bathroom can cause false alarms, hazard system 300 can select a constant that takes this into account. As another example, the home owner can specify that the room includes a fireplace. Similarly, hazard system 300 can select a constant that takes this factor into account.

In another embodiment, hazard detection system 300 can apply heuristics to self-adjust the constant. For example, conditions may persist that keep triggering pre-alarms, but the conditions do not rise to alarming levels. In response to such persistent pre-alarm triggering, hazard detection system 300 can modify the constant so that the pre-alarms are not so easily triggered. In yet another embodiment, the constant can be changed in response to a software update. For example, a remote server may analyze data acquired from several other hazard detection systems and adjust the constant accordingly, and push the new constant to hazard detection system 300 via a software update. In addition, the remote server can also push down constants based on user settings or user preferences to hazard detection system 300. For example, the home owner may be able to define a limited number of settings by directly interacting with hazard detection system 300. However, the home owner may be able to define an unlimited number of settings by interacting with, for example, a web-based program hosted by the remote server. Based on the settings, the remote server can push down one or more appropriate constants.

The sensor state machines can control alarming states 330 and one or more of other states 320. In particular, smoke sensor state machine 314 can control smoke alarm state 331, CO sensor state machine 316 can control CO alarming state 332, and heat sensor state machine 318 can control heat alarming state 333. For example, smoke sensor state machine 314 may be operative to sound alarm 350 in response to a detected smoke event. As another example, CO sensor state machine 316 can sound alarm 350 in response to a detected CO event. As yet another example, heat sensor state machine 318 can sound alarm 350 in response to a detected heat event. In some embodiments, a sensor state machine can exercise exclusive control over one or more alarming states 330.

The system state machines can control pre-alarming states 340 and one or more of other states 320. In particular, smoke system state machine 315 may control smoke pre-alarm state 341, and CO system state machine 317 may control CO pre-alarm state 342. In some embodiments, each system state machine can manage multiple pre-alarm states. For example, a first pre-alarm state may warn a user that an abnormal condition exists, and a second pre-alarm state may warn the user that the abnormal condition continues to exist. Moreover, each system state machine can manage other states that cannot be managed by the sensor state machines. For example, these other states can include a monitoring state, a pre-alarm hushing state, and post-alarm states such as holding and alarm monitoring states.

The system state machines can co-manage one or more states with sensor state machines. These co-managed states ("shared states") can exist as states in both system and sensor state machines for a particular hazard. For example, smoke system state machine 315 may share one or more states with smoke sensor state machine 314, and CO system state machine 317 may share one or more states with CO sensor state machine 316. The joint collaboration between system and sensor state machines for a particular hazard is shown by communications link 370, which connects the two state machines. In some embodiments, any state change transition to a shared state may be controlled by the sensor state machine. For example, the alarming state may be a shared state, and anytime a sensor state machine transitions to the alarming state, the system state machine that co-manages states with that sensor state machine may also transition to the alarming state. In some embodiments, shared states can include idling states, alarming states, and alarm hushing states. The parameters by which multi-criteria state machines 310 may function are discussed in more detail in connection with the description accompanying FIGS. 4A-8B of U.S. Provisional Patent Application No. 61/847,937.

Figure 4:
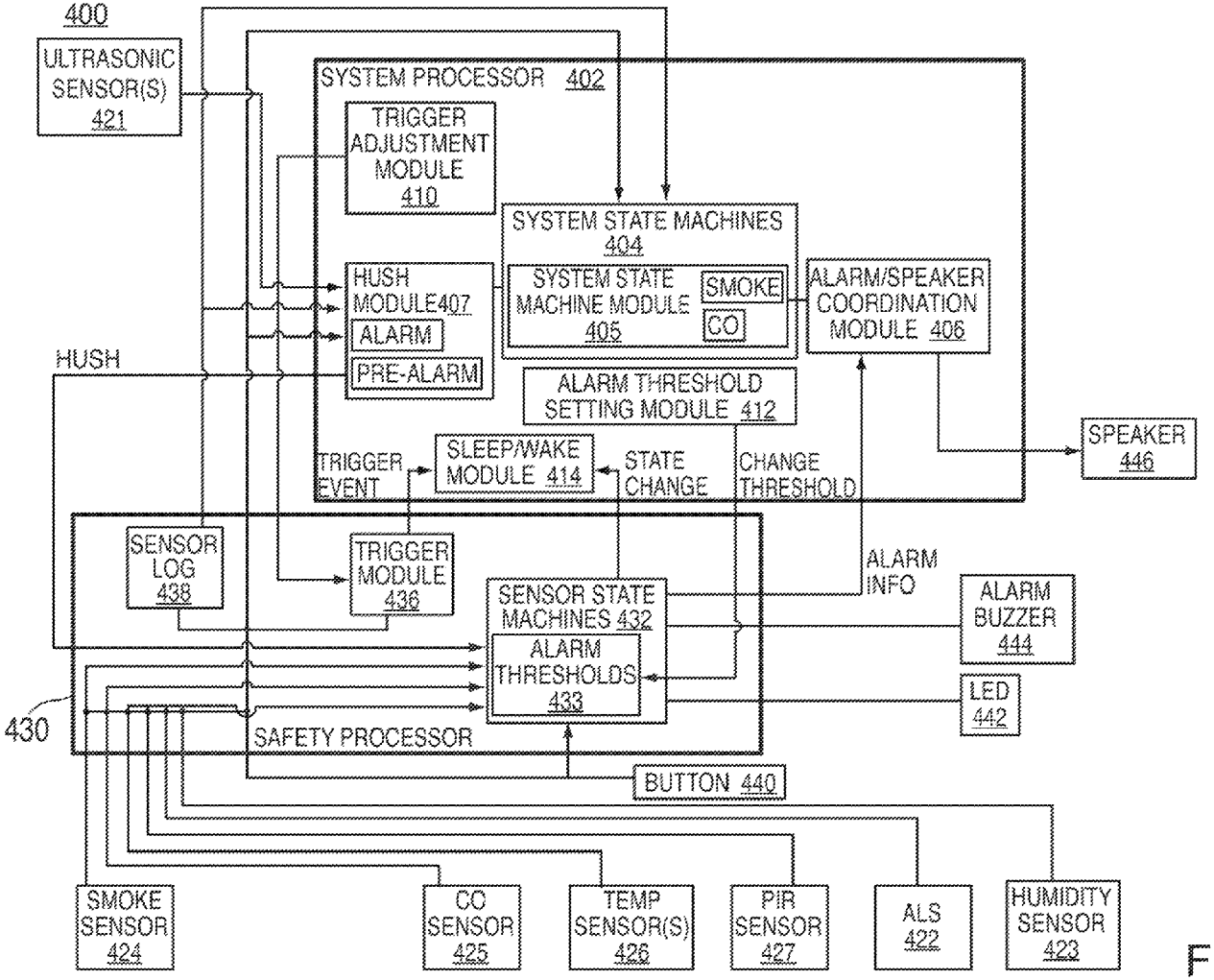
FIG. 4 shows an illustrative schematic of a hazard detection system, according to some embodiments.

FIG. 4 shows an illustrative schematic of hazard detection system 400 according to an embodiment and shows, among other things, signal paths among various components, state machines, and illustrative modules being executed by different processors. System 400 can include system processor 402, safety processor 430, ultrasonic sensors 421, ALS sensor 422, humidity sensor 423, smoke sensor 424, CO sensor 425, temperatures sensors 426, and PIR sensor 427, button 440, LED(s) 442, alarm 444, and speaker 446. System processor 402 can be similar to system processor 210 of FIG. 2. System processor 402 can operate system state machines 404, system state machine module 405, alarm/speaker coordination module 406, hush module 407, trigger adjustment module 410, and sleep/wake module 414. System state machines 404 can access system state machine module 405, alarm/speaker coordination module 406, and hush module 407 in making state change determinations. System processor 402 can receive data values acquired by ultrasonic sensors 421 and other inputs from safety processor 430. System processor 402 may receive data from sensors 422-427, data from sensor log 438, trigger events from trigger module 436, state change events and alarm information from sensor state machines 432, and button press events from button 440.

Safety processor 430 can be similar to safety processor 230 of FIG. 2. Safety processor 430 can operate sensor state machines 432, alarm thresholds 433, trigger module 436, and sensor log 438. Safety processor 430 can control operation of LEDs 442 and alarm 444. Safety processor 430 can receive data values acquired by sensors 422-427 and button 440. All or a portion of acquired sensor data can be provided to sensor state machines 432. For example, as illustrated in FIG. 4, smoke, CO, and heat sensor data is shown being directly provided to sensor state machines 432. Sensor log 438 can store chunks of acquired data that can be provided to system processor 402 on a periodic basis or in response to an event such as a state change in one of sensor state machines 432 or a trigger event detected by trigger module 436. In addition, in some embodiments, even though the sensor data may be stored in sensor log 438, it can also be provided directly to system processor 402, as shown in FIG. 4.

Alarm thresholds 433 can store the alarming thresholds in a memory (e.g., Flash memory) that is accessible by sensor state machines 432. As discussed above, sensor state machines 432 can compare monitored sensor data values against alarm thresholds 433 that may be stored within safety processor 430 to determine whether a hazard event exists, and upon determining that the hazard event exists, may cause the alarm to sound. Each sensor (e.g., smoke sensor, CO sensor, and heat sensor) may have one or more alarm thresholds. When multiple alarm thresholds are available for a sensor, safety processor 430 may initially select a default alarm threshold, but responsive to an instruction received from system processor 402 (e.g., from Alarm/Pre-Alarm Threshold Setting Module 412), it can select one of the multiple alarm thresholds as the alarm threshold for that sensor. Safety processor 430 may automatically revert back to the default alarm threshold if certain conditions are not met (e.g., a predetermined period of time elapses in which an alarm setting threshold instruction is not received from system processor 402).

Safety processor 430 and/or system processor 402 can monitor button 440 for button press events. Button 440 can be an externally accessible button that can be depressed by a user. For example, a user may press button 440 to test the alarming function or to hush an alarm. Safety processor 430 can control the operation of alarm 444 and LEDs 442. Processor 430 can provide alarm information to alarm/speaker coordination module 406 so that module 406 can coordinate speaker voice notification with alarm sounds. In some embodiments, safety processor 430 is the only processor that controls alarm 444. Safety processor 430 can also receive inputs from system processor 402 such as hush events from hush module 407, trigger band boundary adjustment instructions from trigger adjustment module 410, and change threshold instructions from alarm/pre-alarm threshold setting module 412.

As shown, hazard detection system 400 may use a bifurcated processor arrangement to execute the multi-criteria state machines to control the alarming and pre-alarming states, according to various embodiments. The system state machines can be executed by system processor 402 and the sensor state machines can be executed by safety processor 430. As shown, sensor state machines 432 may reside within safety processor 430. This shows that safety processor 430 can operate sensor state machines such as a smoke sensor state machine, CO sensor state machine, and heat sensor state machine. Thus, the functionality of the sensor state machines (as discussed above) are embodied and executed by safety processor 430. As also shown, system state machines 404 may reside within system processor 402. This shows that system processor 402 can operate system state machines such as a smoke system state machine and a CO system state machine. Thus, the functionality of the system state machines (as discussed above) are embodied and executed by system processor 402.

In the bifurcated approach, safety processor 430 can serve as the "brain stem" of hazard detection system 400 and system processor 402 can serve as the "frontal cortex." In human terms, even when a person goes to sleep (i.e., the frontal cortex is sleeping) the brain stem maintains basic life functions such as breathing and heart beating. Comparatively speaking, safety processor 430 is always awake and operating; it is constantly monitoring one or more of sensors 422-427, even if system processor 402 is asleep or non-functioning, and managing the sensor state machines of hazard detection system 400. When the person is awake, the frontal cortex is used to processes higher order functions such as thinking and speaking. Comparatively speaking, system processor 402 performs higher order functions implemented by system state machines 404, alarm/speaker coordination module 406, hush module 407, trigger adjustment module 410, and alarm/pre-alarm threshold setting module 412. In some embodiments, safety processor 430 can operate autonomously and independently of system processor 402. Thus, in the event system processor 402 is not functioning (e.g., due to low power or other cause), safety processor 430 can still perform its hazard detection and alarming functionality.

The bifurcated processor arrangement may further enable hazard detection system 400 to minimize power consumption by enabling the relatively high power consuming system processor 402 to transition between sleep and non-sleep states while the relatively low power consuming safety processor 430 is maintained in a non-sleep state. To save power, system processor 402 can be kept in the sleep state until one of any number of suitable events occurs that wakes up system processor 402. Sleep/wake module 414 can control the sleep and non-sleep states of system processor 402. Safety processor 430 can instruct sleep/wake module 414 to wake system processor 402 in response to a trigger event (e.g., as detected by trigger module 436) or a state change in sensor state machines 432. Trigger events can occur when a data value associated with a sensor moves out of a trigger band associated with that sensor. A trigger band can define upper and lower boundaries of data values for each sensor and are stored with safety processor 430 in trigger module 436. Trigger module 436 can monitor sensor data values and compare them against the boundaries set for that particular sensor's trigger band. Thus, when a sensor data value moves out of band, trigger module 436 registers this as a trigger event and notifies system processor 402 of the trigger event (e.g., by sending a signal to sleep/wake module 414).

The boundaries of the trigger band can be adjusted by system processor 402, when it is awake, based on an operational state of hazard detection system 400. The operational state can include the states of each of the system and sensor state machines, sensor data values, and other factors. System processor 402 may adjust the boundaries of one or more trigger bands to align with one or more system state machine states before transitioning back to sleep. Thus, by adjusting the boundaries of one or more trigger bands, system processor 402 effectively communicates "wake me" instructions to safety processor 430. The "wake me" instructions can be generated by trigger adjustment module 410 and transmitted to trigger module 436, as shown in FIG. 4. The "wake me" instructions can cause module 436 to adjust a boundary of one or more trigger bands.

Systems and methods of compensating for sensor drift of a sensor are described herein. Sensors may drift for a variety of different reasons, many of which may depend on the type of sensor in use. For the purposes of this disclosure and for ease of discussion, the sensor referred to herein may be a smoke sensor. In particular, the smoke sensor may be a type that uses at least one radiation source (e.g., infrared LED) and at least one radiation detector (e.g., photodetector) to detect the presence of smoke and other particles. This type of smoke sensor is sometimes referred to as a light scattering smoke sensor.

Such a smoke sensor may rely on scattering of light or radiation in order to detect presence of particles such as smoke within an enclosure of the smoke sensor. Thus, when particles exist within the enclosure, light emitted by the radiation source is scattered, and if the scattering is sufficient, the radiation detector can detect the scattered light. If relatively few or no particles exist within the enclosure when light is being emitted by the radiation source, the light may not be sufficiently scattered to be detected by the radiation detector.

In order to detect the presence of smoke, a process may poll the smoke sensor on a periodic basis and obtain "light" and "dark" readings to calculate a sensor value. The "light" reading may represent the raw analog-to-digital (ADC) reading obtained from the smoke sensor when the sensor's light source is turned ON. The "dark" reading may represent the raw analog-to-digital (ADC) reading obtained from the smoke sensor when the sensor's light source is turned OFF. The sensor value may be calculated by subtracting the "dark" reading from the "light" reading. When the air contained within the smoke sensor enclosure is "clear" (i.e., no particles are present), the sensor value may not have a zero value, but rather, it may have a value known as the clear air offset value. The clear air offset value may represent the value reported by the smoke sensor when no particles are present within the enclosure. However, when dust particles accumulate within the enclosure or the performance of the radiation source and/or radiation detector degrades over time, the "clear air" sensor value may change, thereby causing the sensor to drift. As such, the clear air offset value can be changed according to various embodiments described herein to account for dust and component performance degradation. In a normal usage case, as the system resides on the wall or ceiling, dust may slowly accumulate over time, thereby causing sensor drift. If the system is placed in a high density particulate environment, the dust may accumulate at a faster rate, thereby causing accelerated sensor drift.

As defined herein, an upward sensor drift, which causes the "clear air" sensor value to rise, may be the result of an increase in accumulated dust within an enclosure. Dust may be any particle or combination of particles that affect the clear air offset value. As defined herein, a downward sensor drift, which causes the "clear air" sensor value to fall, may be the result of a decrease in accumulated dust. A decrease in accumulated dust may be caused by a clean event. As defined herein, a clean event may be the occurrence of any event that directly or indirectly causes a downward sensor drift.

Figure 5:
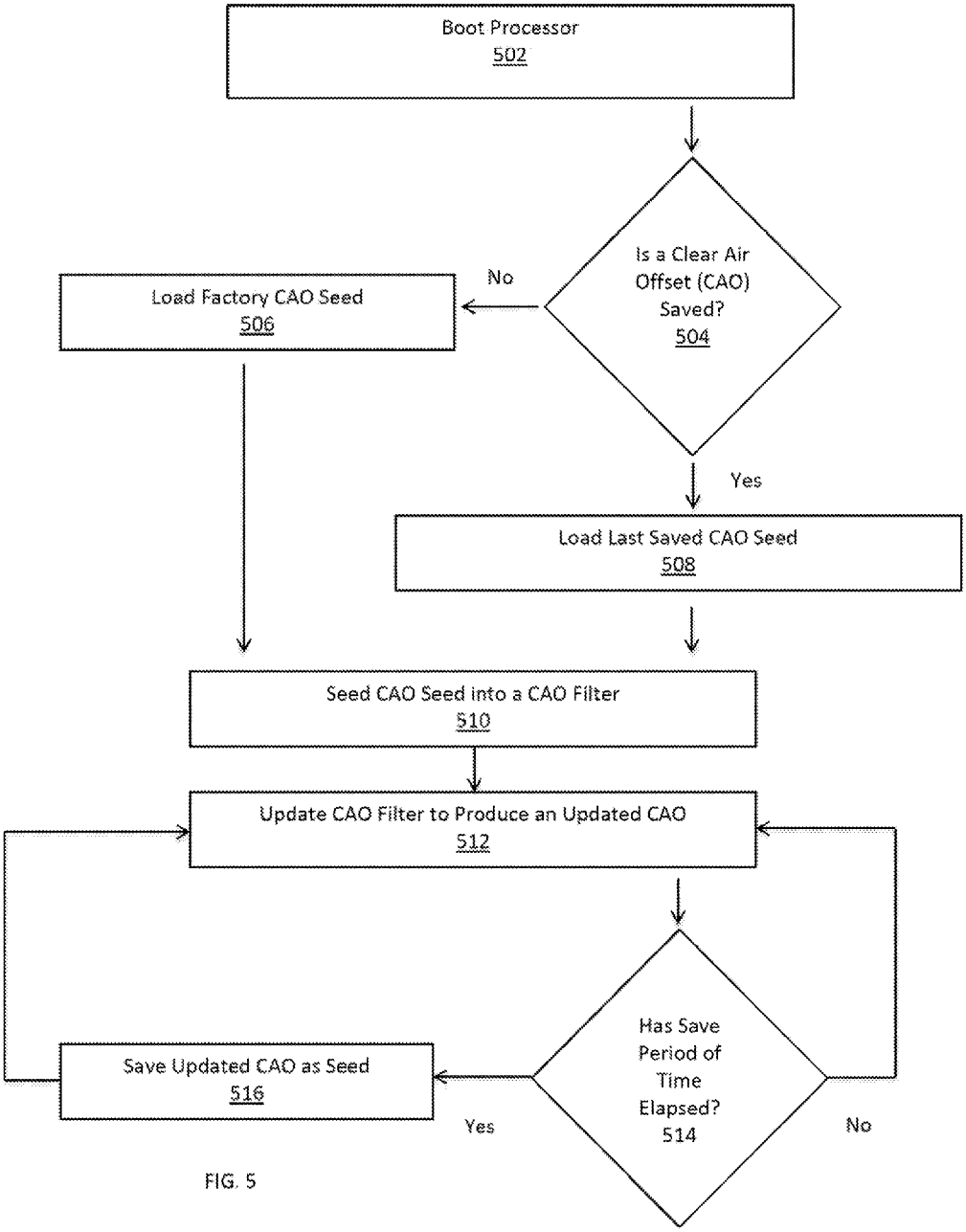
FIG. 5 shows an illustrative flowchart of process steps that may be implemented by a hazard detection system, according to an embodiment.

FIG. 5 shows an illustrative flowchart of process steps that may be implemented by a hazard detection system according to an embodiment. Beginning at step 502, a processor such as the safety processor (e.g., safety processor 230 or 430) may be booted. At step 504, a determination is made as to whether a clear air offset ("CAO") is saved, for example, in a non-volatile storage such as non-volatile memory 216 or non-volatile storage contained within the processor. If the determination at step 504 is NO, a factory CAO seed may be loaded into a volatile memory (at step 506) for use as a seed in clear air offset filter. The CAO filter may be the filter responsible for adjusting the CAO in response to sensor drift, and the seed may be an initial starting value for the CAO. The CAO filter may be any suitable filter such as for example, an infinite impulse response (IIR) filter. If the determination at step 504 is YES, the saved CAO seed may be loaded into a volatile memory (at step 508) for use as a seed in the CAO filter. After either step 506 or 508, the loaded CAO seed can be used by the CAO filter.

The CAO filter may use the CAO seed as a basis for updating the filter every first time period to produce updated CAO values, as indicated by step 510. The first time period may be any suitable length of time. However, as will become more apparent in the discussion below, the first time period may be relatively brief or quick compared to other time periods, such as the second time period in step 512. For example, the first time period may be on the order of several seconds, or a few minutes, whereas the second time period may be on the order of several days or weeks. In some embodiments, the first time period may be about the same as the sample rate that the processor (e.g., safety processor) polls the smoke sensor, CO sensor, and/or other sensors to acquire sensor data. Additional details on how the filter is updated are described below in connection with the description accompanying FIGS. 6-9.

At step 514, a determination is made whether a second time period has lapsed. If the determination at step 514 is NO, the process continues back to step 512. If the determination is YES, the current value of the updated CAO may be saved or stored in the non-volatile memory. This way, in the event of a system reset or a power OFF/ON event, the processor can load the saved CAO in lieu of the factory CAO. The second time period may be several orders of magnitude larger than the first time period. For example, the first time period may be on the order of seconds, whereas the second time period may be on the order of days.

Figure 6:
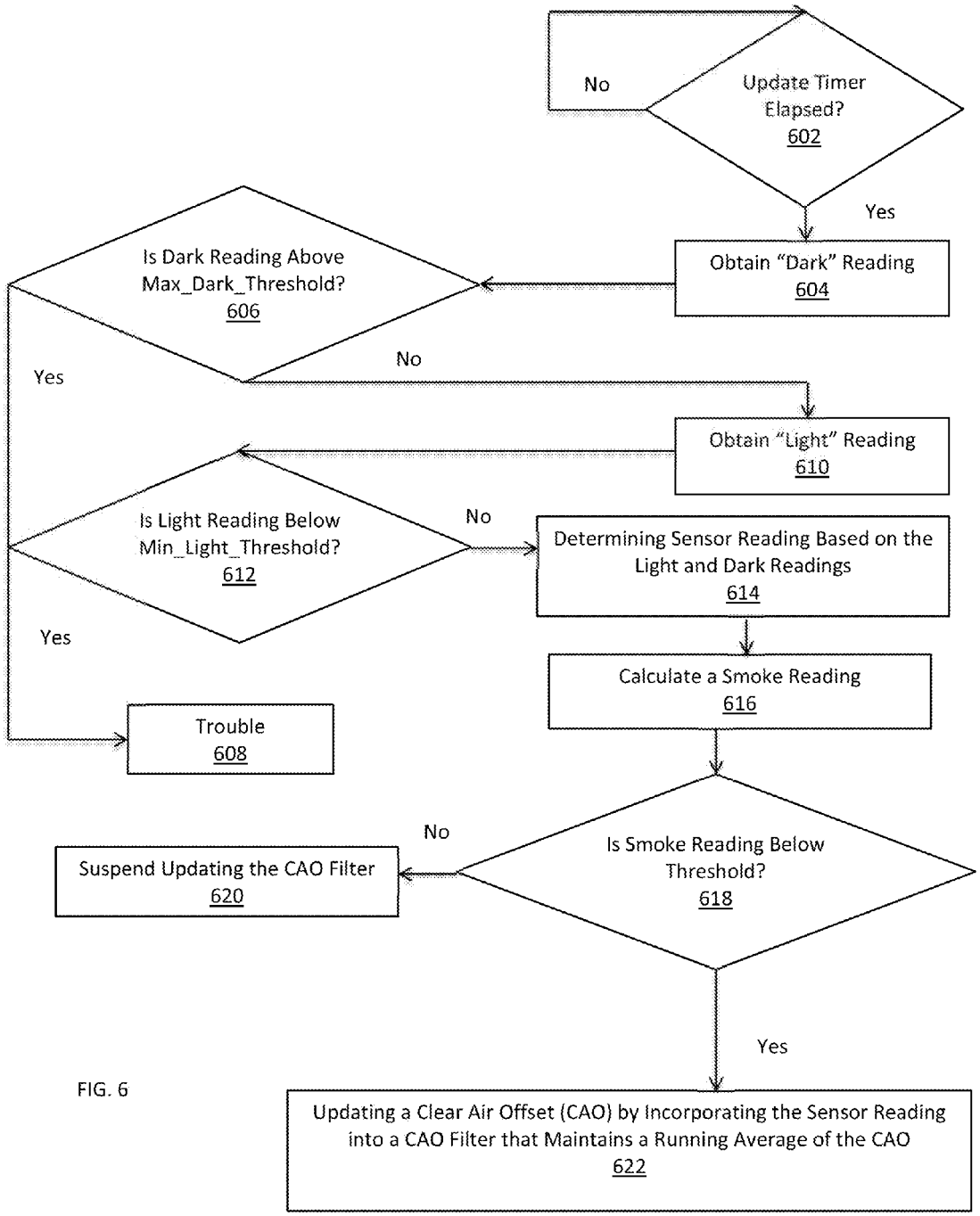
FIG. 6 shows an illustrative flowchart illustrating steps for updating a clear air offset value, according to an embodiment.

FIG. 6 shows an illustrative flowchart illustrating steps that may be implemented during step 512 of FIG. 5, according to an embodiment. Starting with step 602, a determination may be made whether an update timer has elapsed. The update timer may be part of a processor (e.g., safety processor) that polls sensors every first time period. The sensor polling time period may change depending on the system status. For example, if no hazardous conditions are detected, the processor may poll its sensors at a first polling time period, but if a hazardous condition is detected, the processor may poll its sensors at a second polling time period, which is faster than the first polling time period. In one embodiment, for example, the first polling time period may be every 200 seconds. If the update tinier has not elapsed, the process loops back to step 602, but if the update timer has elapsed, a "dark" reading is obtained from the smoke sensor, as indicated by step 604. The "dark" reading may represent the raw analog-to-digital (ADC) reading obtained from the smoke sensor when the sensor's light source is turned OFF. This "dark" reading may be compared to a max_dark_threshold in step 606 to determine if it is above that threshold. If the "dark" reading is above the max_dark_threshold, the system may signal trouble at step 608. The trouble signal may be expressed in any suitable manner, such as for example, by changing a color of an LED, providing a warning chirp, providing a warning message, or communicating with a remote server via the Internet.

If the "dark" reading is not above the max_dark_threshold, the system may obtain a "light" reading from the smoke sensor, as indicated by step 610. The "light" reading may represent the raw ADC reading obtained from the smoke sensor when the sensor's light source is turned ON. This "light" reading may be compared to a min_light_threshold at step 612 to determine if it is below that threshold. If "light" reading is below the min_light_threshold, the system may signal trouble at step 608. If the "light" reading is not below the min_light_threshold, the system may determine a sensor_value based on the light and dark readings, as indicated by step 614.

The sensor_value may be calculated by taking the difference between the light and dark readings. For example, equation 1 below may be used to determine the sensor_value.

$$\text{Sensor_value}=\text{ADC}_{Light}-\text{ADC}_{Dark} \quad (1)$$

where $\text{ADC}_{Light}$ is the "light" reading and $\text{ADC}_{Dark}$ is the "dark" reading.

At step 616, a smoke_level_value may be calculated based, in part, on the sensor_value, the CAO, and a calibration constant. For example, equation 2 may be used to determine the smoke_reading.

$$\text{Smoke_level_value}=C\times(\text{Sensor_value}-\text{CAO}) \quad (2)$$

where C is a calibration constant associated with smoke sensor, sensor_value is derived from equation 1, above, and CAO is the clear air offset, which is a filtered average determined by a filter according to an embodiment. The smoke_level_value may be used by the processor to determine whether to sound an alarm or enter into a different state (e.g., pre-alarm state). In addition, the smoke_level_value may be used to determine whether the sensor_value can be fed into the filter. At step 618, a determination is made whether the smoke_level_value is less than a threshold. If the determination is NO, the system may suspend updating the filter by preventing the sensor_value from being used as an input to the filter. The system may suspend using the sensor_value as a filter input when the smoke_level_value exceeds, or equals, the threshold to prevent artificial inflation of the CAO, or to divert all system resources to handling hazard events.

If the determination, at step 618, is YES, the system may update the CAO value by incorporating the sensor_value into a filter that maintains a running average of the offset value over time, as indicated in step 622. Thus, when the system is operating in an idle, or non-heightened state, the filter may be fed with the sensor_values so that sensor drift can be accommodated. The filter may be represented by equation 3, shown below, may be a IIR filter.

$$F_n=\alpha\times\text{sensor_value}+(1-\alpha)\times F_{n-1} \quad (3)$$

where $F_n$ is the updated CAO, $\alpha$ is a time constant, and $F_{n-1}$ is the value of the previous CAO. In some embodiments, the time constant, $\alpha$, may be selected such that the filter has a settling time of several days (e.g., 3-6 days, or 4 days). For example, even when the sensor_value step changes to a new magnitude, and remains at that new magnitude, the filter may require the full time duration of the settling time to update the CAO to the new magnitude. This way, if the smoke sensor is tracking a "fast moving" smoke event or other transient event, for example, the filter will not be able to update the CAO at the same rate the sensor_values are changing. As such, the smoke events and other cyclic transients are effectively filtered out by the filter.

Figure 7A:
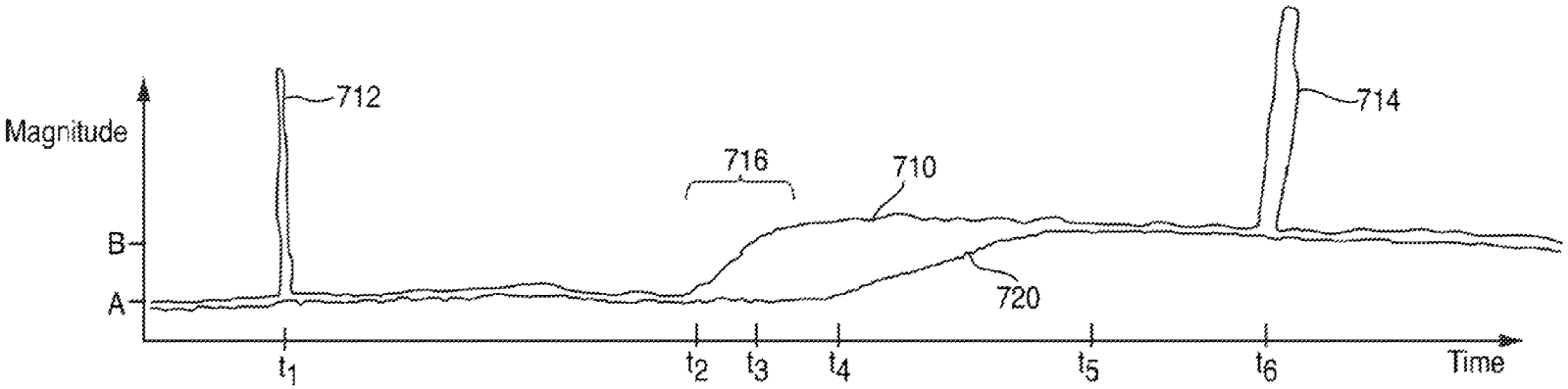
FIGS. 7A and 7B show illustrative timing diagrams, according to various embodiments.
Figure 7B:
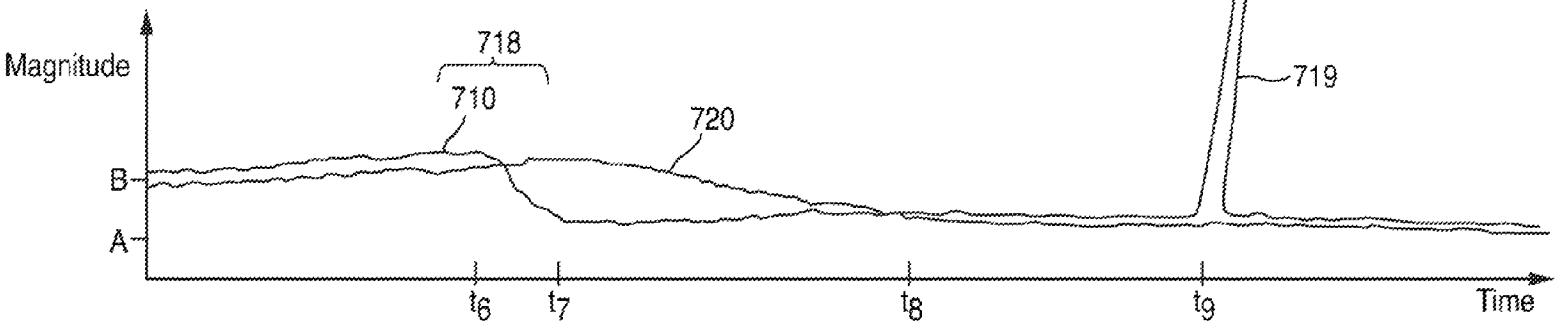

FIGS. 7A and 7B show illustrative timing diagrams of sensor_values 710 and CAO values 720 over time, according to various embodiments. FIG. 7A shows that the sensor_values 710 exhibit spikes 712 and 714 at times, t1 and t6, respectively, and exhibits drift 716 between times t2 and t3. Spikes 712 and 714 may represent relatively short time durations during which sensor values rapidly increase from an initial magnitude to a final magnitude and rapidly falls back to that initial magnitude, and as such may have caused a change in a system operational state (e.g., change from idle state to an alarm state, or other non-idle state). Despite the rapid increase of the $\text{sensor}_{13}$ values of spikes 712 and 714, the CAO values 720 remained relatively unchanged. However, drift 716 may represent a permanent change in sensor values 710. As shown, sensor value 710 increases from magnitude A, at time, t2, to magnitude B, at time, t3, during drift 716. CAO value 720 may begin to change in value at time, t4, but does not settle until time, t5. Thus, at time, t5, CAO value 720 is updated to reflect drift 716, and as a result, the floor for the smoke_reading calculation is changed, thereby potentially making the smoke sensor more sensitive than when the CAO value was centered around magnitude A.

FIG. 7B may represent a continuation of FIG. 7A, where sensor value 710 and CAO values 720 are centered around magnitude B. At time, t6, sensor value 710 starts to decrease from magnitude B to magnitude A, at time, t7. A clean event may have commenced at time, t6. This decrease may represented by drift 718. As shown, CAO value 720 may begin to drop shortly after time, t7, but it does not settle until time, t8, at which point, both reading 710 and CAO value 720 are centered around magnitude A. Then, at time, t9, spike 719 occurs, but has negligible impact on CAO value 720.

Figure 8:
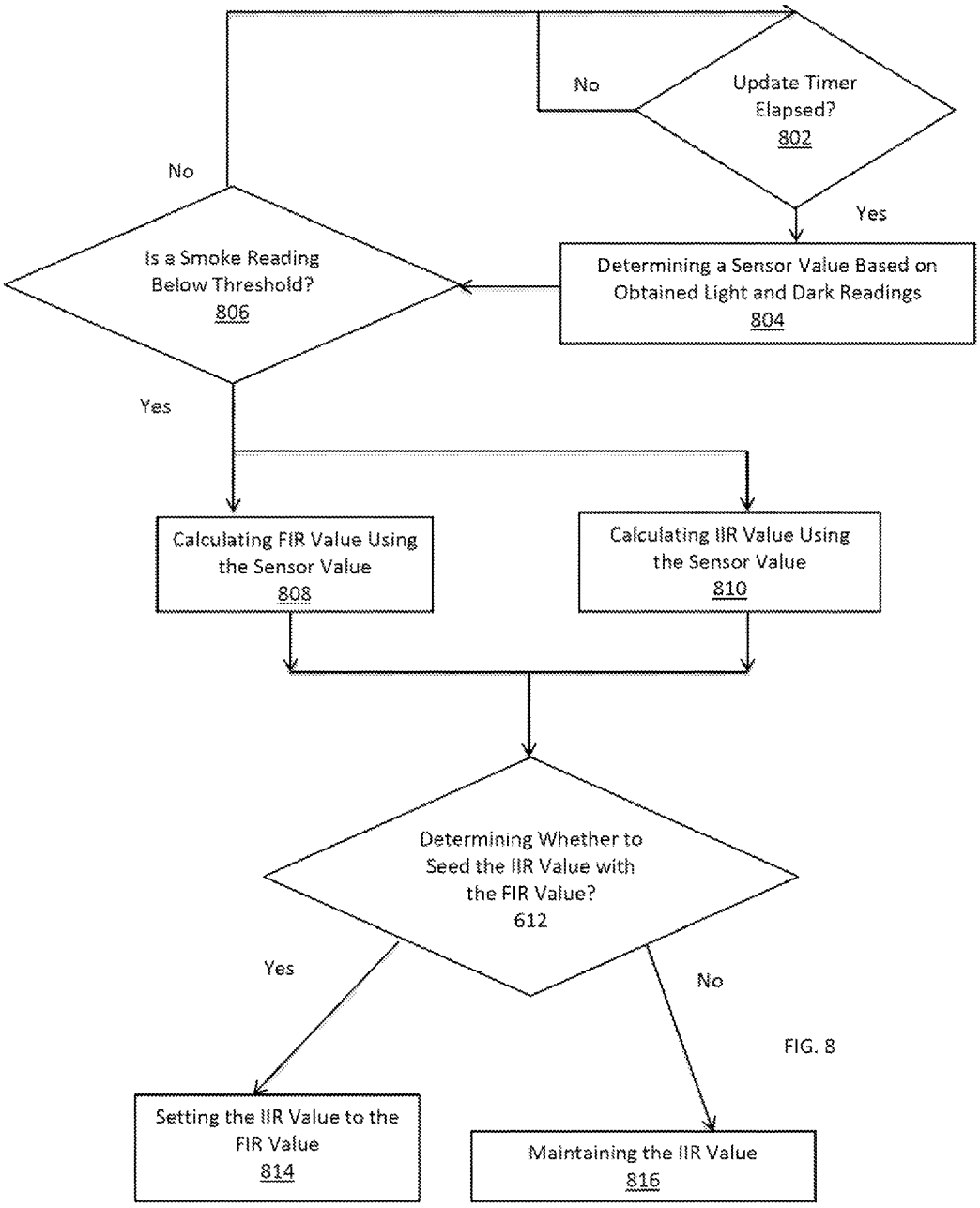
FIG. 8 shows another illustrative flowchart illustrating steps for updating a clear air offset value, according to an embodiment.

FIG. 8 shows another illustrative flowchart illustrating steps that may be implemented during step 512 of FIG. 5, according to an embodiment. Starting with step 802, a determination may be made whether an update timer has elapsed. If the update timer has not elapsed, the process loops back to step 802, but if the update timer has elapsed, a sensor_value can be determined based on "light" and "dark" readings obtained from the smoke sensor, as indicated by step 804. At step 806, a determination is made whether a smoke_level_value is less than a threshold. As discussed above, the smoke_level_value can be obtained by using equation 3. If the determination at step 806 is NO, the system may signal trouble or return to step 802. If the determination at step 806 is YES, the system proceeds to steps 808 and 810.

At step 808, a finite impulse response ("FIR") value can be calculated using a FIR filter, sometimes referred to as a clean event value. The FIR value may represent a moving average of sensor_values. As will be explained in more detail below, the FIR value may be used to cause an immediate step change in the CAO value. For example, in one embodiment, the FIR value may be represented by equation 4:

$$\text{FIR}=y[n]=(x[n]+x[n-1]+x[n-2]+x[n-3]-\min(x[n],x[n-1],x[n-2],x[n-3]))/3 \quad (4)$$

where y[n] represents the current FIR value at time, n, x represents the sensor_value at a particular time (e.g., x[n] is the instant sensor_value, and x[n−1] is the previous sensor_value), and min function eliminates the lowest sensor_value of the four sensor_value samples. The minimization function may be used to eliminate a potentially errant sensor value. Although the moving average in equation 4 only includes a three sample average, it is understood that any suitable number of samples may be used to calculate an average for the FIR value.

At step 810, the system may calculate an IIR value using an IIR filter. The IIR value may incorporate the sensor_value into an IIR filter that maintains a running average of the CAO value over time. The IIR filter may be represented by equation 5, shown below.

$$\text{IIR}=Y_n=\alpha\times X_n+(1-\alpha)\times Y_{n-1} \quad (5)$$

where $Y_n$ is the updated CAO, $\alpha$ is a time constant, $X_n$ is the sensor_value, and $Y_{n-1}$ is the value of the previous CAO. In some embodiments, the time constant, $\alpha$, may be selected such that the IIR filter has a settling time of several days. In some embodiments, the $\alpha$ of equation 5 may be selected such that the settling time exceeds the settling time of equation 3.

At step 812, a determination is made whether to seed the IIR value with the FIR value. This determination can be made by evaluating the equation 6:

$$\text{IF } ((\text{FIR}+z)<\text{IIR}) \text{ THEN IIR}=\text{FIR} \quad (6)$$

where FIR is the result of equation 4, z is a FIR threshold to account for noise, and IIR is the result of equation 5. Thus, if determination of step 812 is YES, then the IIR value is set to the FIR value, as indicated by step 814. Setting the IIR value to the FIR value may enable the IIR to be rapidly stepped down, as opposed to waiting for the IIR value to settle (which may be days according to some embodiments). In addition, enabling the IIR value to be reduced at a rate faster than the IIR settling rate may decrease the sensitivity of the smoke sensor, thereby reducing the potential for false alarms or enhanced system operational states which may result in needless power consumption. If the determination of step 812 is NO, then the IIR value is maintained as calculated, for example, in equation 5. After either step 814 or 816, the system may return to step 802.

Figure 9A:
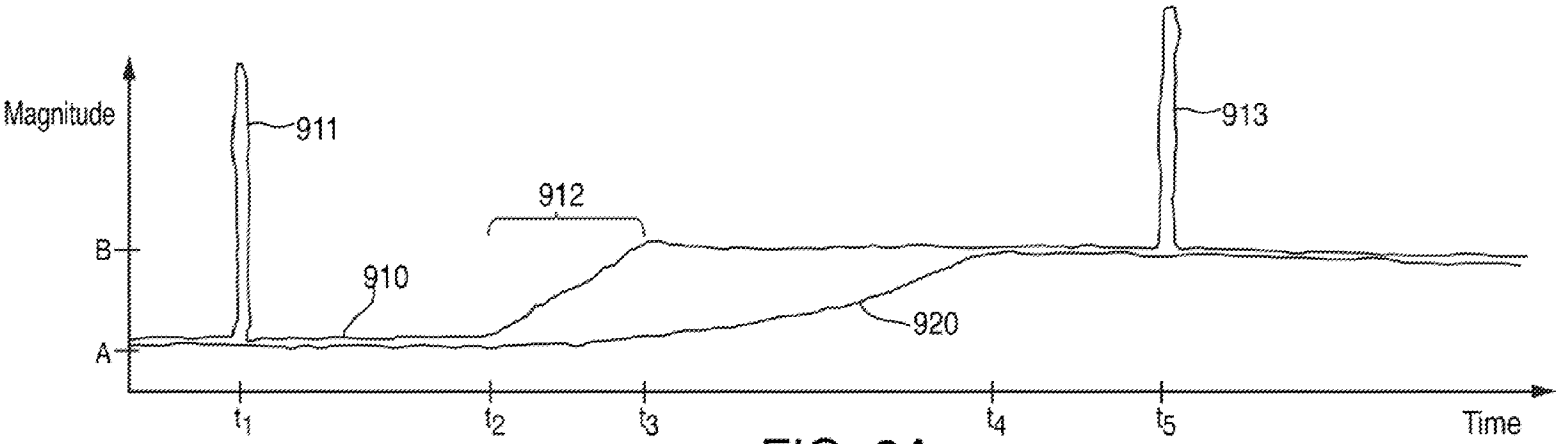
FIGS. 9A and 9B show illustrative timing diagrams, according to various embodiments.
Figure 9B:
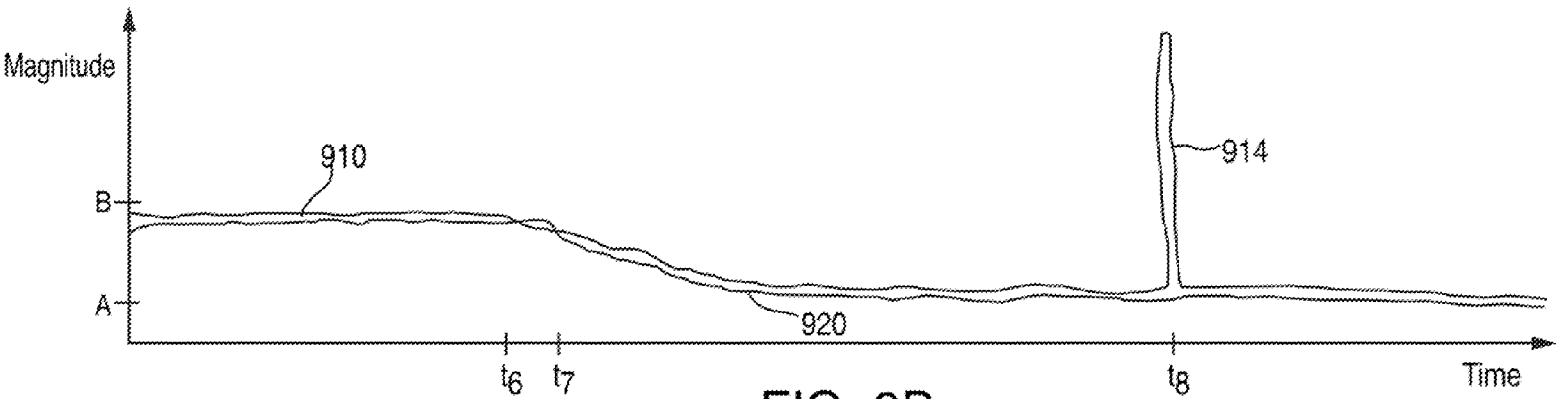

FIGS. 9A and 9B show illustrative timing diagrams of sensor_values 910 and IIR values 920 over time, according to various embodiments. At time, t1, a spike 911 exists in sensor_values 910, but this had negligible effect on IIR values 920. As explained above, this is because the settling time of IIR is many magnitudes slower than the changes in sensor_values 910. At time, t2, drift 912 commences and ends at time, t3, resulting in sensor_values 910 changing from magnitude A to magnitude B. As shown, although sensor value 910 stabilized around magnitude B at time, t3, IIR value 920 does not stabilize around magnitude B until time, t4. Thus, at time, t4, the IIR value has drifted to a higher magnitude, at least compared to where the IIR values were at time, t2. As a result, this may cause the smoke sensor to be more sensitive, for example, when a spike 913 occurs at time, t5. Referring now specifically to FIG. 9B, at time, t6, sensor_values 910 begin to drop. In addition, in a manner that is substantially commensurate with the drop in sensor_values 910, IIR values 920 also drop, as indicated at time, t7. The drop in IIR values may lag the drop in sensor_values 910 by a few samples (e.g., the number of samples needed for calculating the FIR value), but it is much faster than the settling time of the IIR filter. As such, IIR values 920 may be permitted to drop substantially immediately, thereby decreasing the sensitivity of the smoke sensor. Thus, when spike 914 occurs at time, t8, the smoke sensor may have additional head room to operate because the CAO has been lowered.

Thus, it will be appreciated that a comparison between the IIR updating process of FIGS. 6 and 8 shows that the IIR updating process of FIG. 8 has two separate factors that can be adjusted, whereas the IIR updating process of FIG. 7 has one factor, to achieve desired clear air offset determination performance. In the process of FIG. 6, both upward and downward IIR value changes are controlled by the settling time of its IIR filter. In the process of FIG. 8, upward IIR changes are controlled its IIR filter, but downward changes in the IIR values can be controlled by FIR values. The FIR values can provide an independent mechanism for downwardly adjusting the IIR values in a manner much faster than the IIR filter. Thus, because the FIG. 8 process has two separate factors, the settling time for upward drift can be set to an exceedingly long duration without compromising the ability to quickly adjust for downward drift.

Figure 10:
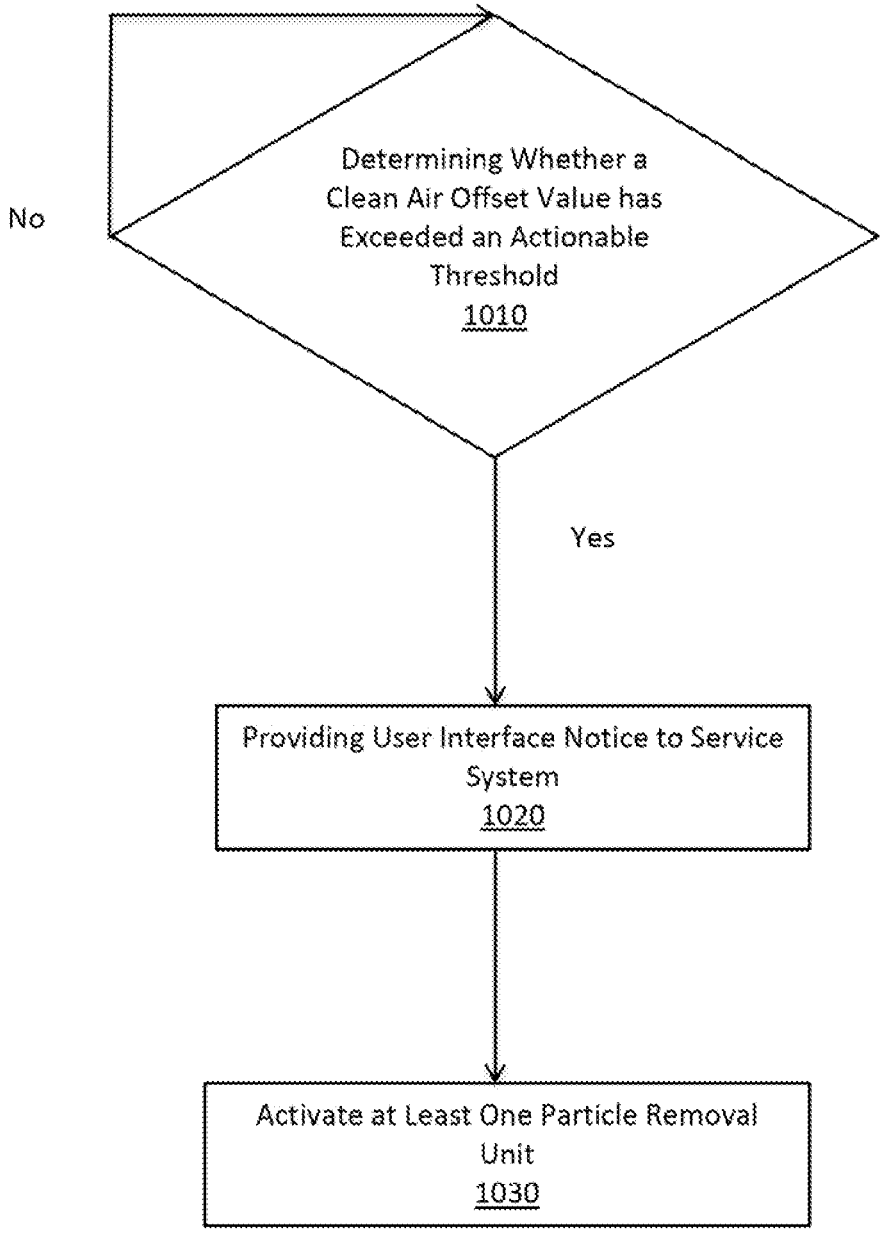
FIG. 10 shows an illustrative flowchart of steps that may be taken in response to monitored sensor drift is shown, according to an embodiment.

FIG. 10 shows an illustrative flowchart of steps that may be taken in response to monitored sensor drift is shown, according to an embodiment. At step 1010, a determination is made whether a clear air offset value has exceeded an actionable threshold. The CAO value may be obtained, for example, using any of the embodiments discussed above. The actionable threshold may be any suitable threshold. For example, the threshold can be set at a fixed value above the factory seeding value stored in the non-volatile memory. If the determination at step 1010 is NO, the process may loop back to step 1010. If the determination is YES, the process may proceed to step 1020.

At step 1020, a user interface notice may be provided to indicate that the system requires servicing. The notice may provide instructions to clean the smoke sensor by, for example, blasting the system with compressed air to thereby dislodge any dust that may have accumulated therein. The notice may indicate that the system has been placed in a high density particulate area and suggest that it be moved. The notice may be provided as an email message or text message to users associated with the system, or it may be provided in the form of a spoken message via the system's speaker.

At step 1030, at least one particle removal unit may be activated to remove or dislodge any particulate matter that may have settled within the smoke sensor. A particle removal unit can be a device or component specifically dedicated to the task of removing or dislodging particulates. For example, such a unit may be a bottle of compressed air that is contained within the system and that is operative to blow air into or around the smoke sensor. As another example, the unit may be a fan. The particle removal unit may be another device or component that serves another function within the system, but can serve double usage for particle removal. For example, a speaker, which is ordinarily used for playing back messages, may be used to emit acoustic signals of particular frequencies to dislodge particles. As yet another example, an alarm, which is ordinarily used to alert the user of a hazardous condition, may be activated to remove or agitate particles. After step 1030, the process may loop back to step 1010.

It is understood that the steps shown FIG. 10 are merely illustrative and that the order of the steps may be rearranged, that additional steps may be added, and steps may be omitted. For example, a step may be added after step 1030 that checks whether a user initiated clean event or a system initiated clean event was successful in removing particulate matter from the smoke sensor. If it is determined that the cleaning attempt(s) were not successful, the system may prevent further messages from being provided or cease further activation of the particle removal unit to avoid disturbing users and/or consuming power.

Dust or other particulates may enter into a smoke sensor, and remain therein temporarily before exiting out of the smoke sensor. Such particulates may not come to rest or become permanently fixed within the smoke sensor and therefore have no long term effect on sensor drift. They may, however, have a short term effect on the calculation of the clear air offset. As such, it may be desirable to discount or minimize their effect on the clear air offset calculation.

Figure 11:
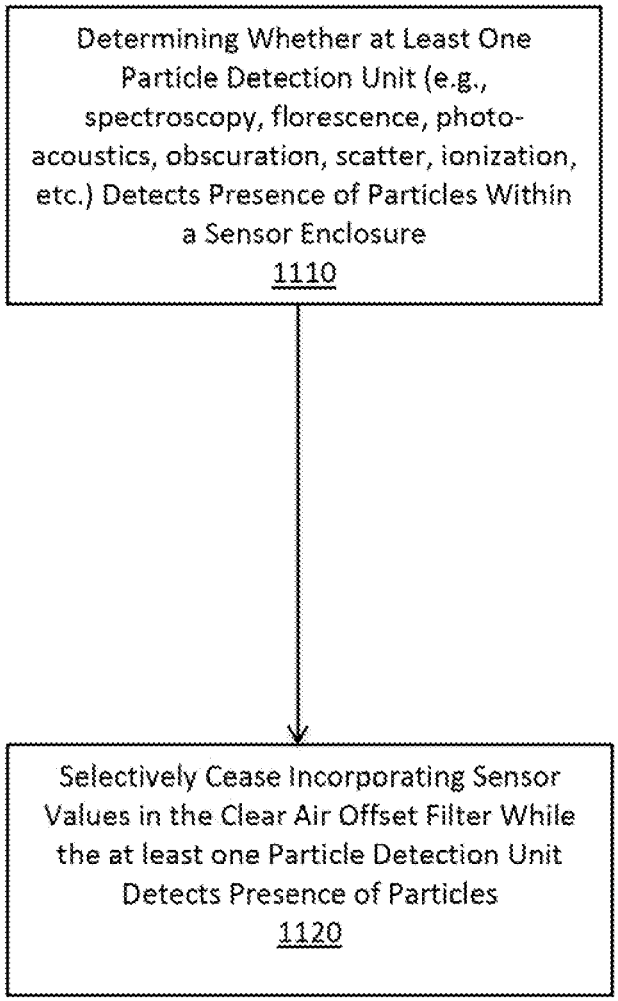
FIG. 11 shows an illustrative flowchart of steps for identifying the presence of particles within a sensor enclosure and selectively choosing not to provide inputs to a CAO filter, in accordance with an embodiment.

FIG. 11 shows an illustrative flowchart of steps for identifying the presence of particles within a sensor enclosure and selectively choosing not to provide inputs to a CAO filter, in accordance with an embodiment. Starting with step 1110, a determination is made whether at least one particle detection unit detects presence of one or more particles within a sensor enclosure. The particle detection unit may use any one of several different types of detection techniques. These techniques can include, for example, spectroscopy, florescence, photoacoustic tomography, obscuration, scatter, and ionization. Some of these techniques may be able to independently detect the presence of particles, whereas others may need to work in combination with at least one other technique to detect particles. For example, photoacoustic detection may be able to independently detect presence of a particle floating through the enclosure. As another example, readings from scattering and obscuration techniques may be compared with each other to determine whether a floating particle exists within the enclosure. In some embodiments, the particle detection units may be able discern a size of detected particles.

At step 1120, the system may selectively cease to incorporate sensor readings (e.g., sensor_values) into a clear air offset filter while the at least one particle detection unit detects presence of particles. Thus, when a particle is detected, any readings obtained as part of the sensor polling process (e.g., the sensor_value) may not be provided to the IIR filter being used to calculate the clear air offset value. This avoids artificially increasing the CAO value due to one or more transient particles. If desired, the detected particle size may be taken into account in determining whether to selectively cease incorporating sensor readings. For example, if the particle size exceeds a minimum size threshold, the system may decide not to use the sensor_values.

It is understood that although the embodiments described herein with respect to a hazard detection system, these embodiments may also be used in any system or device where it is desired to maintain sensing and monitoring of other events while updating the operational capabilities of one of more components of that system or device. For example, the other events can include events that are not necessarily tied to hazards such as smoke, CO, and heat, but can include motion detection, sound detection, and the like. Events reported by remote devices may also be taken into account. For example, security device such as window and door sensor, and motion detection sensors that provide feedback to a system may quality as other events.

Any processes described with respect to FIGS. 1-11, as well as any other aspects of the invention, may each be implemented by software, but may also be implemented in hardware, firmware, or any combination of software, hardware, and firmware. They each may also be embodied as machine- or computer-readable code recorded on a machine- or computer-readable medium. The computer-readable medium may be any data storage device that can store data or instructions which can thereafter be read by a computer system. Examples of the computer-readable medium may include, but are not limited to, read-only memory, random-access memory, flash memory, CD-ROMs, DVDs, magnetic tape, and optical data storage devices. The computer-readable medium can also be distributed over network-coupled computer systems so that the computer readable code is stored and executed in a distributed fashion. For example, the computer-readable medium may be communicated from one electronic subsystem or device to another electronic subsystem or device using any suitable communications protocol. The computer-readable medium may embody computer-readable code, instructions, data structures, program modules, or other data in a modulated data signal, such as a carrier wave or other transport mechanism, and may include any information delivery media. A modulated data signal may be a signal that has one or more of its characteristics set or changed in such a manner as to encode information in the signal.

It is to be understood that any or each module or state machine discussed herein may be provided as a software construct, firmware construct, one or more hardware components, or a combination thereof. For example, any one or more of the state machines or modules may be described in the general context of computer-executable instructions, such as program modules, that may be executed by one or more computers or other devices. Generally, a program module may include one or more routines, programs, objects, components, and/or data structures that may perform one or more particular tasks or that may implement one or more particular abstract data types. It is also to be understood that the number, configuration, functionality, and interconnection of the modules or state machines are merely illustrative, and that the number, configuration, functionality, and interconnection of existing modules may be modified or omitted, additional modules may be added, and the interconnection of certain modules may be altered.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Therefore, reference to the details of the preferred embodiments is not intended to limit their scope.

What is claimed is:

1. A method of compensating for sensor drift of a smoke sensor, comprising:

calculating a smoke level value based, in part, on a sensor value calculated based on readings obtained from the smoke sensor and a clear air offset value; and adjusting the clear air offset value in response to changes in dust accumulation within an enclosure of the smoke sensor such that an increase in accumulated dust causes an upward sensor drift and a decrease in accumulated dust causes a downward sensor drift, wherein the adjusting comprises:

using a first filter to calculate a reseed value based, in part, on the sensor value;

using a second filter to calculate an adjusted clear air offset value based, in part, on the sensor value and the clear air offset value; and selectively setting the clear air offset value to one of the adjusted clear air offset value and the reseed value depending on whether a downward sensor drift is detected.

2. The method of claim 1, wherein selectively setting the clear air offset value to the reseed value enables the clear air offset value to be set to a new magnitude at a rate faster than a rate at which the second filter can settle the adjusted clear air offset to the same new magnitude.

3. The method of claim 1, wherein the first filter comprises a finite impulse response filter and wherein the second filter comprises an infinite impulse response filter.

4. The method of claim 1, wherein setting the clear air offset value to the reseed value results in a step change in magnitude that is controlled by a first settling period, and wherein setting the clear air offset to the adjusted clear air offset value results in a step change in magnitude that is controlled by a second settling period, wherein the second settling time period is a least one order of magnitude higher than the first settling time period.

5. The method of claim 4, wherein the second settling time period is such that the second filter filters out sensor values that are not directly related to accumulation of dust within the enclosure.

6. The method of claim 4, wherein changes to the clear air offset as a result of the upward sensor drift are made according to the second settling time period and changes to the clear air offset as a result of the downward sensor drift are made according to the first settling time period.

7. The method of claim 4, further comprising:

obtaining the readings from the smoke sensor every sample period, wherein each of the sensor value, the reseed value, and the adjusted clear offset value is updated each sample period.

8. The method of claim 7, wherein the first settling time period is about the same as the sample period.

9. The method of claim 1, wherein the downward sensor drift is detected when the sum of the reseed value and a noise constant is less than the adjusted clear air offset value.

10. The method of claim 1, further comprising periodically saving the clear air offset value in a non-volatile memory.

11. The method of claim 1, further comprising executing at least one state machine by determining state transitions based, in part, on the smoke level value.

12. The method of claim 1, further comprising:

using at least one particle detection unit to detect the presence of at least one transient particle within an enclosure of the smoke sensor; and ceasing to provide the sensor value to the first and second filters while the at least one transient particle is detected.

13. The method of claim 1, further comprising:

determining whether the clear air offset value exceeds an actionable threshold; and activating at least one particle removal unit in response to a determination that the clear air offset value exceeds the actionable threshold.

14. The method of claim 1, further comprising:

determining whether the clear air offset value exceeds an actionable threshold; and providing a notice with instructions to service the smoke sensor in response to a determination that the clear air offset value exceeds the actionable threshold.

15. A hazard detection system, comprising:

at least one safety sensor comprising a smoke sensor;

a safety processor operative to:

determine a sensor value based on data obtained from the smoke sensor every sample period;

determine a smoke level value based, in part, on the sensor value and a clear air offset value;

execute at least one sensor state machine by determining state transitions based, in part, on the smoke level value; and update the clear air offset value each sample period by incorporating the sensor value into a filter, wherein the filter comprises a rate of change scaling factor that substantially limits a magnitude impact the sensor value has on the updated clear air offset value.

16. The system of claim 15, wherein the data obtained from the at least one sensor comprises a dark data reading and a light data reading, and wherein the sensor reading is the result of a difference between the light and dark data readings.

17. The system of claim 16, wherein the safety processor is operative to:

determine whether the dark data reading exceeds a dark data reading threshold; and activate a trouble signal in response to a determination that the dark data reading exceeds a dark data reading threshold.

18. The system of claim 16, wherein the safety processor is operative to:

determine whether the light data reading is less than a light data reading threshold; and activate a trouble signal in response to a determination that the light data reading is less than a light data reading threshold.

19. The system of claim 15, wherein the rate of change scaling factor is selected such that the filter filters out sensor readings that are not directly related to accumulation of dust within an enclosure of the smoke sensor.

20. The system of claim 15, wherein the safety processor is operative to:

calculate a clean event value every sample period; and selectively set the clean air offset value to be equivalent to the clean event value in response to a detected clean event.

21. The system of claim 20, wherein the clean event value is calculated using a filter that maintains a moving average of a fixed number of sensor readings.

22. The system of claim 20, wherein the detected clean event exists when the sum of the clean event value and a noise constant is less than the clean air offset value.

23. The system of claim 15, wherein the safety processor is operative to:

during boot of the safety processor, retrieve the clear air offset value from a non-volatile memory; and seed the filter with the retrieved clear air offset value.

24. The system of claim 15, wherein the safety processor is operative to store the clear air offset value in a non-volatile memory.

25. The system of claim 15, further comprising:

a system processor operative to execute at least one system state machine by determining state transitions based, in part, on the smoke value.

26. The system of claim 25, wherein the safety processor is characterized by relatively low power consumption and relatively limited processing power in comparison to that of the system processor, and wherein the safety processor is operative to independently activate an alarm regardless of whether the system processor is functioning.

27. The system of claim 25, further comprising at least one particle removing unit, wherein at least one of the safety processor and the system processor is operative to activate the at least one particle removing unit in response to a determination that the clear air offset value exceeds an actionable threshold.

28. The system of claim 25, wherein at least one of the safety processor and the system processor is operative to provide a notice that indicates a detected presence of accumulated dust within an enclosure of the smoke sensor in response to a determination that the clear air offset value exceeds an actionable threshold.

29. The system of claim 15, further comprising:

at least one particle detection unit that is operative to detect transient particles existing within an enclosure of the smoke sensor; and wherein the safety processor is operative to:

selectively cease updating the clear air offset value while the at least one particle detection unit detects the transient particles.

* * * * *